US010607478B1

(12) United States Patent
Stewart et al.

(10) Patent No.: US 10,607,478 B1
(45) Date of Patent: Mar. 31, 2020

(54) BUILDING SECURITY SYSTEM WITH FALSE ALARM REDUCTION USING HIERARCHICAL RELATIONSHIPS

(71) Applicant: Johnson Controls Technology Company, Auburn Hills, MI (US)

(72) Inventors: Michael C. Stewart, Deerfield Beach, FL (US); Gopi Subramanian, Boca Raton, FL (US); Conor J. Donovan, Cork (IE)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/368,620

(22) Filed: Mar. 28, 2019

(51) Int. Cl.
*G08B 29/18* (2006.01)

(52) U.S. Cl.
CPC ..... *G08B 29/185* (2013.01)

(58) Field of Classification Search
CPC ..... G08B 29/185
USPC ..... 340/506
See application file for complete search history.

(56) References Cited

U.S. PATENT DOCUMENTS 5,748,086 A * 5/1998 Bettine ..... G08B 13/2471 340/506
5,917,409 A * 6/1999 Wang ..... G08B 29/24 340/506
6,157,299 A * 12/2000 Wang ..... G08B 25/002 340/506
6,166,633 A * 12/2000 Wang ..... G08B 29/24 340/506
6,198,389 B1 * 3/2001 Buccola ..... G08B 25/008 340/5.3
6,628,323 B1 9/2003 Wegmann
7,302,481 B1 * 11/2007 Wilson ..... H04L 63/0281 709/224
2002/0170002 A1 * 11/2002 Steinberg ..... H04L 41/0609 714/39
2002/0190857 A1 12/2002 Chicca
(Continued)

FOREIGN PATENT DOCUMENTS

EP 3 101 636 A1 12/2016

OTHER PUBLICATIONS

Stackexchange, How Do I Convert the Distance Between Two Lat/Long Points Into Feet/Meters?, https://math.stackexchange.com/questions/29157/how-do-i-convert-the-distance-between-two-lat-long-points-into-feet-meters, retrieved Jul. 6, 2018, 5 pages.

*Primary Examiner* — Ojiako K Nwugo
(74) *Attorney, Agent, or Firm* — Foley & Lardner LLP

(57) ABSTRACT

Systems and methods for reducing false alarms of a building are disclosed. The system includes a processing circuit configured to receive building security data of the building, the building security data comprising one or more events and identify a plurality of satisfied rules of a plurality of rules based on the one or more events, wherein each of the plurality of rules is associated with a particular sequence of one or more particular events. The processing circuit is also configured to select one satisfied rule of the plurality of satisfied rules based on a rule hierarchy, wherein the rule hierarchy indicates a classification level of each of the plurality of satisfied rules and generate a recommendation for reducing a false alarm associated with the one satisfied rule, wherein the recommendation comprises an indication of a root cause of the false alarm.

20 Claims, 15 Drawing Sheets

(56) References Cited

U.S. PATENT DOCUMENTS

| | | | | |
|---|---|---|---|---|
| 2004/0183666 | A1* | 9/2004 | Wang | G08B 29/24 340/506 |
| 2004/0250133 | A1* | 12/2004 | Lim | G06F 21/554 726/23 |
| 2006/0250231 | A1* | 11/2006 | Wang | G08B 29/18 340/507 |
| 2006/0291657 | A1* | 12/2006 | Benson | G05B 13/0275 380/270 |
| 2010/0090822 | A1* | 4/2010 | Benson | G05B 13/0275 340/508 |
| 2011/0032095 | A1 | 2/2011 | Hicks, III | |
| 2011/0178977 | A1* | 7/2011 | Drees | G05B 15/02 706/52 |
| 2012/0008819 | A1 | 1/2012 | Ding et al. | |
| 2013/0033375 | A1* | 2/2013 | Doyle | G08B 21/0236 340/501 |
| 2013/0190095 | A1* | 7/2013 | Gadher | G06F 11/008 463/42 |
| 2014/0211002 | A1* | 7/2014 | Lin | H04N 7/181 348/143 |
| 2014/0266717 | A1 | 9/2014 | Warren et al. | |
| 2017/0061783 | A1 | 3/2017 | Nalukurthy et al. | |
| 2017/0316680 | A1 | 11/2017 | Lamb et al. | |
| 2018/0102045 | A1* | 4/2018 | Simon | G08B 25/08 |
| 2018/0315299 | A1 | 11/2018 | Subramanian et al. | |
| 2018/0315301 | A1* | 11/2018 | Subramanian | G06K 9/6278 |
| 2018/0365593 | A1* | 12/2018 | Galitsky | G06F 21/606 |
| 2018/0375444 | A1 | 12/2018 | Gamroth | |

* cited by examiner

BUILDING SECURITY SYSTEM WITH FALSE ALARM REDUCTION USING HIERARCHICAL RELATIONSHIPS

BACKGROUND

The present disclosure relates generally to building security systems of a building. The present disclosure relates more particularly to systems and methods for reducing future false alarms in the building.

In a building, various building devices provide security monitoring and fire detection and response. A false alarm can be a serious problem for security or fire system. In some cases, the majority of the alarms (e.g., approximately 98%) generated by security or fire systems are false alarms. Responding to false alarms creates a heavy financial burden on customers, police departments, fire departments, and alarm system providers.

False alarms can, in some cases, be attributed to three preventable causes, user error, faulty equipment, and improper equipment installation. Examples of user error may be a user entering an incorrect keypad code into an alarm system, a user leaving a door or window open, or a user leaving objects near motion detectors. In some cases, the equipment itself is faulty. For example, the equipment may be reaching an end of life state and equipment parts may be wearing out or breaking. Regarding improper installation, motion detectors may not be installed in proper areas or placed at the proper heights. In some cases, one error or problem may cause multiple other errors or problems that generate a sequence of false alarms. The sequence of false alarms can result in notifications being sent to police indicating that a police dispatch is needed at a site associated with the alarms. In cases where multiple false alarms occur in a short period of time, it is difficult to identify what initially caused the false alarms because records often only indicate that one alarm caused the police dispatch and ignore any accompanying alarms of a sequence of alarms. Consequently, it is difficult to address a cause for multiple alarms and how the cause can be addressed so the false alarms can be avoided in the future.

SUMMARY

In one implementation, a system for reducing false alarms of a building is disclosed. The system includes a processing circuit configured to receive building security data of the building, the building security data including one or more events identify a plurality of satisfied rules of a plurality of rules based on the one or more events, wherein each of the plurality of rules is associated with a particular sequence of one or more particular events. The processing circuit is also configured to select one satisfied rule of the plurality of satisfied rules based on a rule hierarchy, wherein the rule hierarchy indicates a classification level of each of the plurality of satisfied rules and generate a recommendation for reducing a false alarm associated with the one satisfied rule, wherein the recommendation includes an indication of a root cause of the false alarm.

In some embodiments, each rule of the plurality of rules is associated with a plurality of events occurring in a particular event pattern.

In some embodiments, each rule of the plurality of satisfied rules is associated with a classification level within the rule hierarchy.

In some embodiments, the processing circuit is configured to identify the classification level associated with each of the plurality of satisfied rules; compare the classification level of each of the plurality of satisfied rules; and determine the root cause based on the comparison of the classification level of each of the plurality of satisfied rules.

In some embodiments, the processing circuit is configured to determine the rule hierarchy by receiving historical building data associated with a plurality of root causes; determining a number of instances that each rule of the plurality of rules is satisfied by the historical events; and setting classification levels for each of the plurality of rules based on the number of instances that each rule of the plurality of rules is satisfied.

In some embodiments, the plurality of satisfied rules includes a first satisfied rule and a second satisfied rule, wherein the rule hierarchy associates a first classification level with the first satisfied rule and a second classification level with the second satisfied rule. The processing circuit is configured to: select the first satisfied rule in response to a determination that the first classification level is greater than the second classification level; and generate a first recommendation for reducing a first false alarm associated with the first satisfied rule in response to the determination that the first classification level is greater than the second classification level.

In some embodiments, a first rule of the plurality of rules is associated with a first sequence, wherein the first sequence includes a first event and a second event occurring in order sequentially within a time period. The processing circuit is configured to identify the plurality of satisfied rules by determining whether the first rule is satisfied by identifying whether the one or more events include the first event and the second event occurring in order sequentially within the time period.

In some embodiments, determining whether the first rule is satisfied includes determining whether a third event of the one or more events occurs at a time between the first event and the second event.

In some embodiments, the processing circuit is configured to identify the plurality of satisfied rules of the plurality of rules by generating a list including the one or more events; identifying criteria of each the plurality of rules; wherein the criteria includes one or more particular events and one or more particular sequences of the one or more particular events; and searching the list for the one or more particular events and the one or more particular sequences of the one or more particular events.

In some embodiments, searching the list for the one or more events and the one or more particular sequences of the one or more particular events includes repeatedly searching the list for the one or more particular events and the one or more particular sequences of the one or more particular events for each of the plurality of rules.

In another implementation, a method for reducing false alarms of a building is disclosed. The method is conducted by a processing circuit and includes receiving, by the processing circuit, building security data of the building, the building security data including one or more events; identifying, by the processing circuit, a plurality of satisfied rules of a plurality of rules based on the one or more events, wherein each of the plurality of rules is associated with a particular sequence of one or more particular events; and selecting, by the processing circuit, one satisfied rule of the plurality of satisfied rules based on a rule hierarchy, wherein the rule hierarchy indicates a classification level of each of the plurality of satisfied rules. The method also discloses generating, by the processing circuit, a recommendation for reducing a false alarm associated with the one satisfied rule, wherein the recommendation includes an indication of a root cause of the false alarm.

In some embodiments each rule of the plurality of rules is associated with a plurality of events occurring in a particular event pattern.

In some embodiments, each rule of the plurality of satisfied rules is associated with a classification level within the rule hierarchy. The method includes identifying, by the processing circuit, the classification level associated with each of the plurality of satisfied rules; comparing, by the processing circuit, the classification level of each of the plurality of satisfied rules; and determining, by the processing circuit, the root cause based on the comparison of the classification level of each of the plurality of satisfied rules.

In some embodiments, the method including determining, by the processing circuit, the rule hierarchy by receiving historical building data associated with a plurality of root causes; determining a number of instances that each rule of the plurality of rules is satisfied by the historical events; and setting classification levels for each of the plurality of rules based on the number of instances that each rule of the plurality of rules is satisfied.

In some embodiments, the plurality of satisfied rules includes a first satisfied rule and a second satisfied rule, wherein the rule hierarchy associates a first classification level with the first satisfied rule and a second classification level with the second satisfied rule. The method includes selecting, by the processing circuit, the first satisfied rule in response to a determination that the first classification level is greater than the second classification level and generating, by the processing circuit, a first recommendation for reducing a first false alarm associated with the first satisfied rule in response to the determination that the first classification level is greater than the second classification level.

In some embodiments, a first rule of the plurality of rules is associated with a first sequence, wherein the first sequence includes a first event and a second event occurring in order sequentially within a time period. The method includes identifying, by the processing circuit, the plurality of satisfied rules by determining whether the first rule is satisfied by identifying whether the one or more events include the first event and the second event occurring in order sequentially within the time period.

In some embodiments, determining whether the first rule is satisfied includes determining whether a third event of the one or more events occurs at a time between the first event and the second event.

In some embodiments, identifying the plurality of satisfied rules of the plurality of rules includes generating a list including the one or more events; identifying criteria of each the plurality of rules, wherein the criteria includes one or more particular events and one or more particular sequences of the one or more particular events; and searching the list for the one or more particular events and the one or more particular sequences of the one or more particular events.

In some embodiments, searching the list for the one or more events and the one or more particular sequences of the one or more particular events includes repeatedly searching the list for the one or more particular events and the one or more particular sequences of the one or more particular events for each of the plurality of rules.

A non-transitory computer-readable storage medium having instructions stored thereon that, upon execution by a processor, cause the processor to perform operations to reduce false alarms of a building, the operations including receiving building security data of the building, the building security data including one or more events; identifying a plurality of satisfied rules of a plurality of rules based on the one or more events, wherein each of the plurality of rules is associated with a particular sequence of one or more particular events; and selecting one satisfied rule of the plurality of satisfied rules based on a rule hierarchy, wherein the rule hierarchy indicates a classification level of each of the plurality of satisfied rules. The instructions also cause the processor to perform operations including generating a recommendation for reducing a false alarm associated with the one satisfied rule. The recommendation includes an indication of a root cause of the false alarm.

In some embodiments, each rule of the plurality of satisfied rules is associated with a classification level within the rule hierarchy. The operations include identifying the classification level associated with each of the plurality of satisfied rules; comparing the classification level of each of the plurality of satisfied rules; and determining the root cause based on the comparison of the classification level of each of the plurality of satisfied rules.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Figure 1:
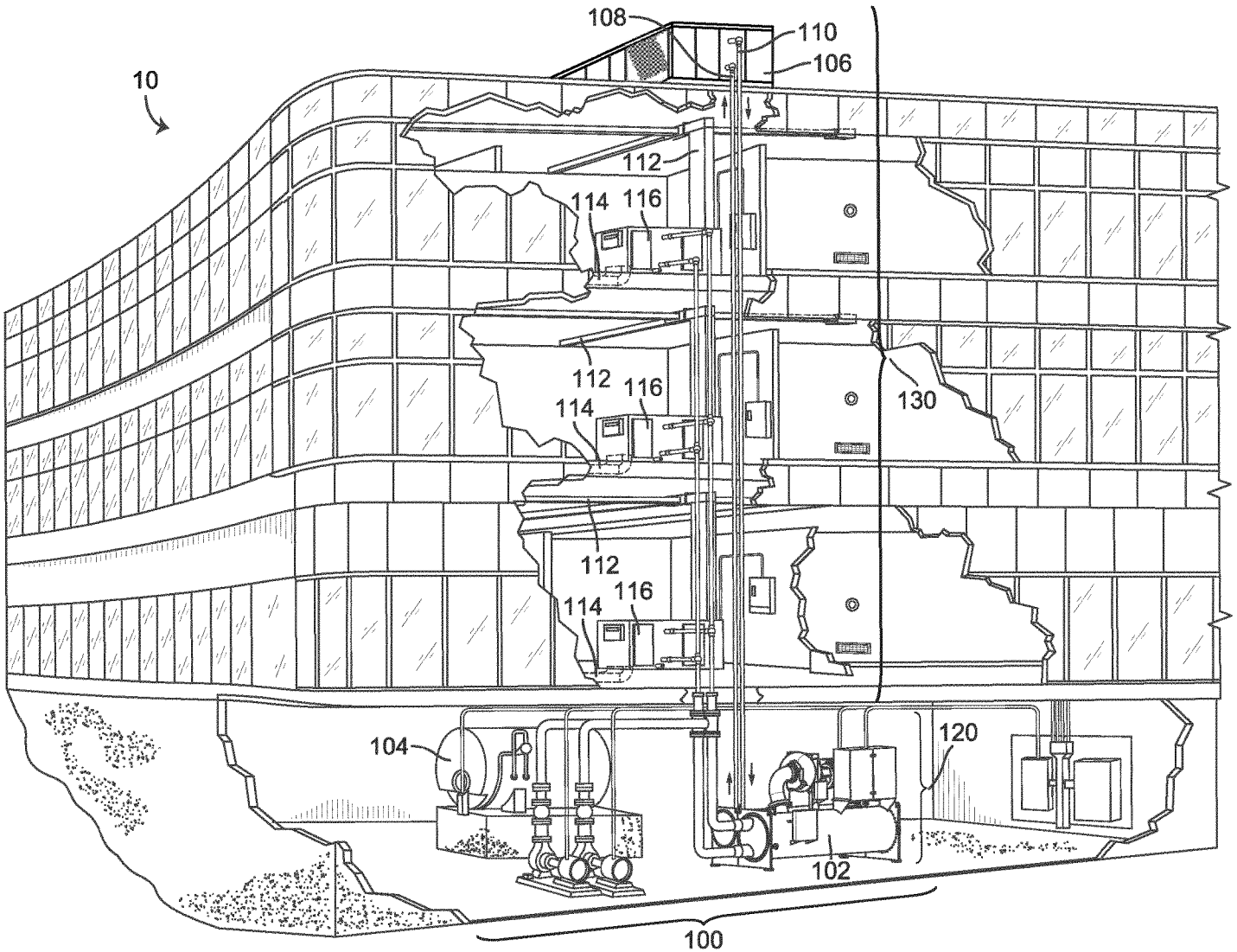
FIG. 1 is a drawing of a building equipped with a HVAC system, according to an exemplary embodiment.

Referring generally to the FIGURES, systems and methods are shown for false alarm reduction for intrusion, fire, and HVAC systems, according to various exemplary embodiments. Building site operators may be unable to distinguish between a true alarm and a false alarm even though the majority of alarms (e.g., approximately 98%) may be false alarms. When multiple false alarms are generated in a short time span, a building owner may be required to fix causes of each individual false alarm. Fixing the causes of each false alarm, which can be identified based on data associated with each false alarm, can be expensive and may not fix the real cause of the false alarms because the real cause may not be identified in the data associated with any of the false alarms.

Various factors can cause false alarms. Some of these factors are system configuration related factors, zone change related factors, users being added or removed to a security system, personal identification codes (PIC) changing, call trees changing, passive infrared (PIR) sensor sensitivity levels, equipment settings or user interactions with equipment, smoke alarms locations (e.g., being located to close to a vent), thermostat locations (e.g., a thermostat being located in a poor location), etc. Furthermore, the particular environment of the building may have active remodeling, floor plan and/or marketing updates, variations in weather, new employees being trained, employee seasonality churn (e.g., temporary and/or seasonal employees) all of which may be a root cause of false alarms in a building site. Furthermore, security systems themselves can fail, tolerances be set incorrect, configurations may be incorrect, and security sensors and devices may be at an end of life state.

The systems and methods disclosed herein can identify a root cause of a sequence of events that triggers multiple false alarm and subsequently a police dispatch. To do so, a controller can store rules that have criteria including event pattern requirements and time thresholds. Event pattern requirements can be requirements that require specific events to occur in a specific order. Other event pattern requirements can require specific events to occur in any order. When a sequence of events and/or false alarms occur, building data can be sent to the controller with associated event data indicating what events were a part of the sequence of events and when they occurred. The controller can identify rules and event patterns of the rules and search the event data associated with a sequence of events for events that match event patterns associated with each rule.

Further the controller can identify time thresholds that indicate a time period that events of an event pattern must occur within to satisfy criteria of a rule. For example, a rule may have criteria requiring that event A occurs five minutes before event B for the criteria to be satisfied. The controller can determine whether events occur within a time period to determine if criteria of a rule is completely satisfied.

In some instances, the controller can determine that criteria for more than one rule can be satisfied. To account for this, the controller can implement a hierarchical relationship that identifies an order of probability that all potential root causes have of being the root cause of a specific sequence of events. The controller can automatically implement the hierarchical relationship by examining historical data and classifying each rule in comparison to each other based on a number of times each rule has been found to be associated with a root cause of a sequence of events. The hierarchical relationship can be dynamic, so as the controller identifies root causes based on false alarms, the controller can incorporate the identified root causes into the data that is used to determine the hierarchical relationship. Consequently, the controller can determine an up-to-date probability model for the hierarchical relationship so the controller can determine the most probable root causes of a sequence of events and/or false alarms.

Once the controller determines all of the rules with satisfied criteria based on a sequence of events, the controller can determine which rule is the most likely cause of the sequence of events based on a hierarchical relationship model. The controller can generate and transmit an action recommendation including instructions on how to fix the root cause, either to a self-healing system within a building system associated with the controller, or to an end user, such as a technician, that can fix the root cause manually.

The systems and methods disclosed herein can assess and reduce false alarms by accurately identifying event patterns in data collected from a building to identify and resolve situations at a building that are causing false alarms, regardless of the number of false alarms that occur in a given time period. Previous security systems analyzed each false alarm separately and provided action recommendations directed to solving the causes of each event. By implementing a root cause analysis system, the systems and methods disclosed herein can consolidate building data associated with events that cause false alarms into a single cause, a root cause, to increase the accuracy of action recommendations and minimize the possibility that a self-healing system or a technician repairs a problem that was only a symptom of a root cause instead of repairing the root cause itself.

Building Management System and HVAC System

Referring now to FIG. 1, an exemplary building management system (BMS) and HVAC system in which the systems and methods of the present invention can be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Figure 2:
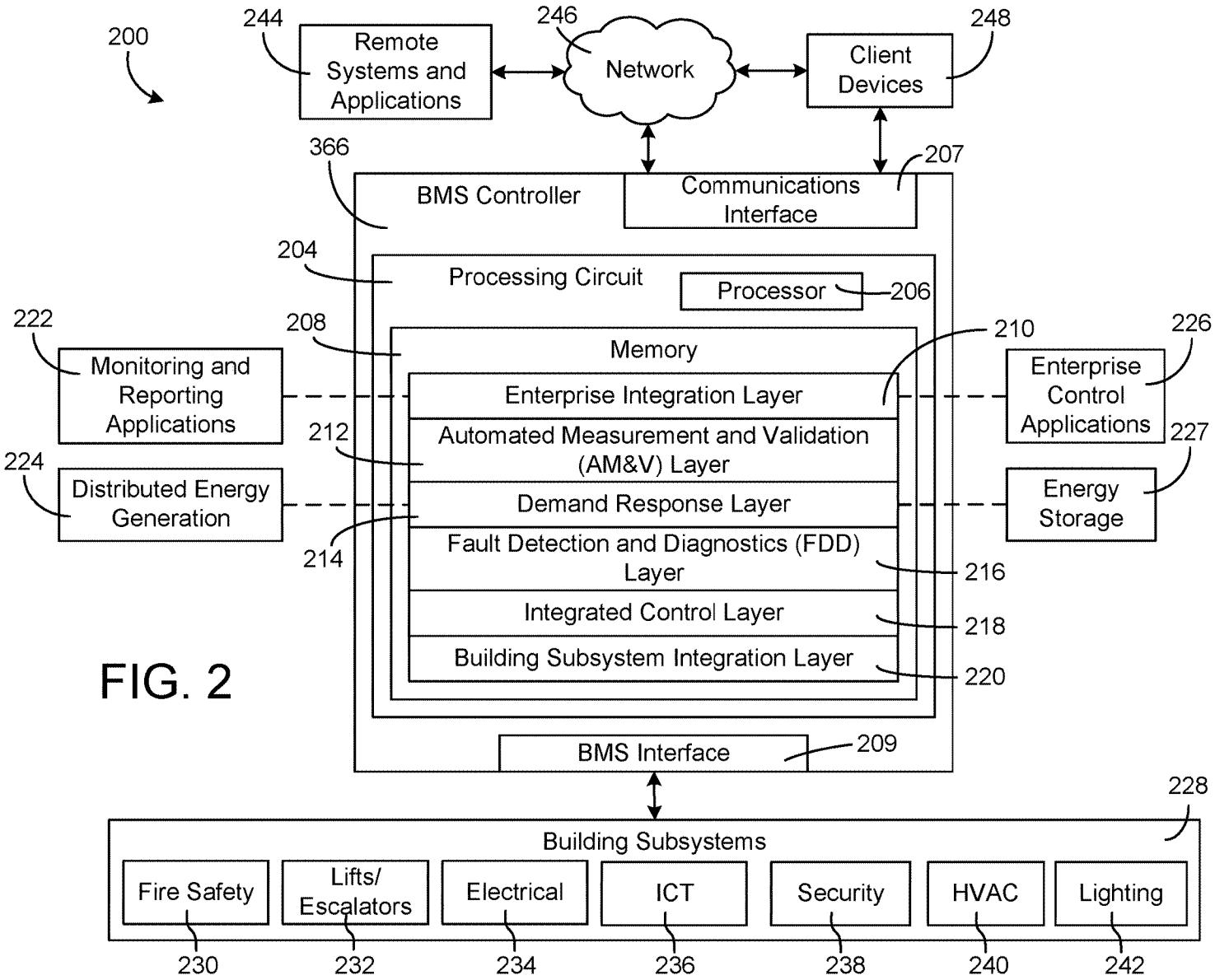
FIG. 2 is a block diagram of a building automation system (BAS) that may be used to monitor and/or control the building of FIG. 1, according to an exemplary embodiment.

Referring now to FIG. 2, a block diagram of a building automation system (BAS) 200 is shown, according to an exemplary embodiment. BAS 200 can be implemented in building 10 to automatically monitor and control various building functions. BAS 200 is shown to include BAS controller 202 and a plurality of building subsystems 228. Building subsystems 228 are shown to include a building electrical subsystem 234, an information communication technology (ICT) subsystem 236, a security subsystem 238, a HVAC subsystem 240, a lighting subsystem 242, a lift/escalators subsystem 232, and a fire safety subsystem 230. In various embodiments, building subsystems 228 can include fewer, additional, or alternative subsystems. For example, building subsystems 228 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 228 include a waterside system and/or an airside system. A waterside system and an airside system are described with further reference to U.S. patent application Ser. No. 15/631,830 (Publication No. 20180375444), filed Jun. 23, 2017, the entirety of which is incorporated by reference herein.

Each of building subsystems 228 can include any number of devices, controllers, and connections for completing its individual functions and control activities. HVAC subsystem 240 can include many of the same components as HVAC system 100, as described with reference to FIG. 1. For example, HVAC subsystem 240 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 242 can include any number of light fixtures, ballasts, lighting sensors, dimmers, or other devices configured to controllably adjust the amount of light provided to a building space. Security subsystem 238 can include occupancy sensors, video surveillance cameras, digital video recorders, video processing servers, intrusion detection devices, access control devices and servers, or other security-related devices.

Still referring to FIG. 2, BAS controller 266 is shown to include a communications interface 207 and a BAS interface 209. Interface 207 can facilitate communications between BAS controller 202 and external applications (e.g., monitoring and reporting applications 222, enterprise control applications 226, remote systems and applications 244, applications residing on client devices 248, etc.) for allowing user control, monitoring, and adjustment to BAS controller 266 and/or subsystems 228. Interface 207 can also facilitate communications between BAS controller 202 and client devices 248. BAS interface 209 can facilitate communications between BAS controller 202 and building subsystems 228 (e.g., HVAC, lighting security, lifts, power distribution, business, etc.).

Interfaces 207, 209 can be or include wired or wireless communications interfaces (e.g., jacks, antennas, transmitters, receivers, transceivers, wire terminals, etc.) for conducting data communications with building subsystems 228 or other external systems or devices. In various embodiments, communications via interfaces 207, 209 can be direct (e.g., local wired or wireless communications) or via a communications network 246 (e.g., a WAN, the Internet, a cellular network, etc.). For example, interfaces 207, 209 can include an Ethernet card and port for sending and receiving data via an Ethernet-based communications link or network. In another example, interfaces 207, 209 can include a Wi-Fi transceiver for communicating via a wireless communications network. In another example, one or both of interfaces 207, 209 can include cellular or mobile phone communications transceivers. In one embodiment, communications interface 207 is a power line communications interface and BAS interface 209 is an Ethernet interface. In other embodiments, both communications interface 207 and BAS interface 209 are Ethernet interfaces or are the same Ethernet interface.

Still referring to FIG. 2, BAS controller 202 is shown to include a processing circuit 204 including a processor 206 and memory 208. Processing circuit 204 can be communicably connected to BAS interface 209 and/or communications interface 207 such that processing circuit 204 and the various components thereof can send and receive data via interfaces 207, 209. Processor 206 can be implemented as a general purpose processor, an application specific integrated circuit (ASIC), one or more field programmable gate arrays (FPGAs), a group of processing components, or other suitable electronic processing components.

Memory 208 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 208 can be or include volatile memory or non-volatile memory. Memory 208 can include database components, object code components, script components, or any other type of information structure for supporting the various activities and information structures described in the present application. According to an exemplary embodiment, memory 208 is communicably connected to processor 206 via processing circuit 402 and includes computer code for executing (e.g., by processing circuit 204 and/or processor 206) one or more processes described herein.

In some embodiments, BAS controller 202 is implemented within a single computer (e.g., one server, one housing, etc.). In various other embodiments BAS controller 202 can be distributed across multiple servers or computers (e.g., that can exist in distributed locations). Further, while applications 222 and 226 exists outside of BAS controller 202, in some embodiments, applications 222 and 226 can be hosted within BAS controller 202 (e.g., within memory 208).

Still referring to FIG. 2, memory 208 is shown to include an enterprise integration layer 210, an automated measurement and validation (AM&V) layer 212, a demand response (DR) layer 214, a fault detection and diagnostics (FDD) layer 216, an integrated control layer 218, and a building subsystem integration later 220. Layers 210-220 can be configured to receive inputs from building subsystems 228 and other data sources, determine optimal control actions for building subsystems 228 based on the inputs, generate control signals based on the optimal control actions, and provide the generated control signals to building subsystems 228. The following paragraphs describe some of the general functions performed by each of layers 210-220 in BAS 200.

Enterprise integration layer 210 can be configured to serve clients or local applications with information and services to support a variety of enterprise-level applications. For example, enterprise control applications 226 can be configured to provide subsystem-spanning control to a graphical user interface (GUI) or to any number of enterprise-level business applications (e.g., accounting systems, user identification systems, etc.). Enterprise control applications 226 can also or alternatively be configured to provide configuration GUIs for configuring BAS controller 202. In yet other embodiments, enterprise control applications 226 can work with layers 210-220 to optimize building performance (e.g., efficiency, energy use, comfort, or safety) based on inputs received at interface 207 and/or BAS interface 209.

Building subsystem integration layer 220 can be configured to manage communications between BAS controller 202 and building subsystems 228. For example, building subsystem integration layer 220 can receive sensor data and input signals from building subsystems 228 and provide output data and control signals to building subsystems 228. Building subsystem integration layer 220 can also be configured to manage communications between building subsystems 228. Building subsystem integration layer 220 translates communications (e.g., sensor data, input signals, output signals, etc.) across a plurality of multi-vendor/multi-protocol systems.

Demand response layer 214 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 224, from energy storage 227, or from other sources. Demand response layer 214 can receive inputs from other layers of BAS controller 202 (e.g., building subsystem integration layer 220, integrated control layer 218, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an exemplary embodiment, demand response layer 214 includes control logic for responding to the data and signals it receives. These responses can include communicating with the control algorithms in integrated control layer 218, changing control strategies, changing setpoints, or activating/deactivating building equipment or subsystems in a controlled manner. Demand response layer 214 can also include control logic configured to determine when to utilize stored energy. For example, demand response layer 214 can determine to begin using energy from energy storage 227 just prior to the beginning of a peak use hour.

In some embodiments, demand response layer 214 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 214 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 214 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 218 can be configured to use the data input or output of building subsystem integration layer 220 and/or demand response later 214 to make control decisions. Due to the subsystem integration provided by building subsystem integration layer 220, integrated control layer 218 can integrate control activities of the subsystems 228 such that the subsystems 228 behave as a single integrated supersystem. In an exemplary embodiment, integrated control layer 218 includes control logic that uses inputs and outputs from a plurality of building subsystems to provide greater comfort and energy savings relative to the comfort and energy savings that separate subsystems could provide alone. For example, integrated control layer 218 can be configured to use an input from a first subsystem to make an energy-saving control decision for a second subsystem. Results of these decisions can be communicated back to building subsystem integration layer 220.

Integrated control layer 218 is shown to be logically below demand response layer 214. Integrated control layer 218 can be configured to enhance the effectiveness of demand response layer 214 by enabling building subsystems 228 and their respective control loops to be controlled in coordination with demand response layer 214. This configuration can reduce disruptive demand response behavior relative to conventional systems. For example, integrated control layer 218 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 218 can be configured to provide feedback to demand response layer 214 so that demand response layer 214 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 218 is also logically below fault detection and diagnostics layer 216 and automated measurement and validation layer 212. Integrated control layer 218 can be configured to provide calculated inputs (e.g., aggregations) to these higher levels based on outputs from more than one building subsystem.

Automated measurement and validation (AM&V) layer 212 can be configured to verify that control strategies commanded by integrated control layer 218 or demand response layer 214 are working properly (e.g., using data aggregated by AM&V layer 212, integrated control layer 218, building subsystem integration layer 220, FDD layer 216, or otherwise). The calculations made by AM&V layer 212 can be based on building system energy models and/or equipment models for individual BAS devices or subsystems. For example, AM&V layer 212 can compare a model-predicted output with an actual output from building subsystems 228 to determine an accuracy of the model.

Fault detection and diagnostics (FDD) layer 216 can be configured to provide on-going fault detection for building subsystems 228, building subsystem devices (i.e., building equipment), and control algorithms used by demand response layer 214 and integrated control layer 218. FDD layer 216 can receive data inputs from integrated control layer 218, directly from one or more building subsystems or devices, or from another data source. FDD layer 216 can automatically diagnose and respond to detected faults. The responses to detected or diagnosed faults can include providing an alarm message to a user, a maintenance scheduling system, or a control algorithm configured to attempt to repair the fault or to work-around the fault.

FDD layer 216 can be configured to output a specific identification of the faulty component or cause of the fault (e.g., loose damper linkage) using detailed subsystem inputs available at building subsystem integration layer 220. In other exemplary embodiments, FDD layer 216 is configured to provide "fault" events to integrated control layer 218 which executes control strategies and policies in response to the received fault events. According to an exemplary embodiment, FDD layer 216 (or a policy executed by an integrated control engine or business rules engine) can shut-down systems or direct control activities around faulty devices or systems to reduce energy waste, extend equipment life, or assure proper control response.

FDD layer 216 can be configured to store or access a variety of different system data stores (or data points for live data). FDD layer 216 can use some content of the data stores to identify faults at the equipment level (e.g., specific chiller, specific AHU, specific terminal unit, etc.) and other content to identify faults at component or subsystem levels. For example, building subsystems 228 can generate temporal (i.e., time-series) data indicating the performance of BAS 200 and the various components thereof. The data generated by building subsystems 228 can include measured or calculated values that exhibit statistical characteristics and provide information about how the corresponding system or process (e.g., a temperature control process, a flow control process, etc.) is performing in terms of error from its setpoint. These processes can be examined by FDD layer 216 to expose when the system begins to degrade in performance and alarm a user to repair the fault before it becomes more severe.

False Alarm Reduction Based on Determining the Root Cause

The systems and methods described herein can include a self-healing system, which can automatically update parameters of different building devices to avoid false alarms in the future. The self-healing system can do so based on data the self-healing system receives from a BMS (e.g., a BMS controller) or a root cause analysis system as will be described below. The self-healing system is further described in U.S. patent application Ser. No. 15/947,722 (Published 20180315299), filed Apr. 6, 2018, which is hereby incorporated by reference in its entirety.

Figure 3:
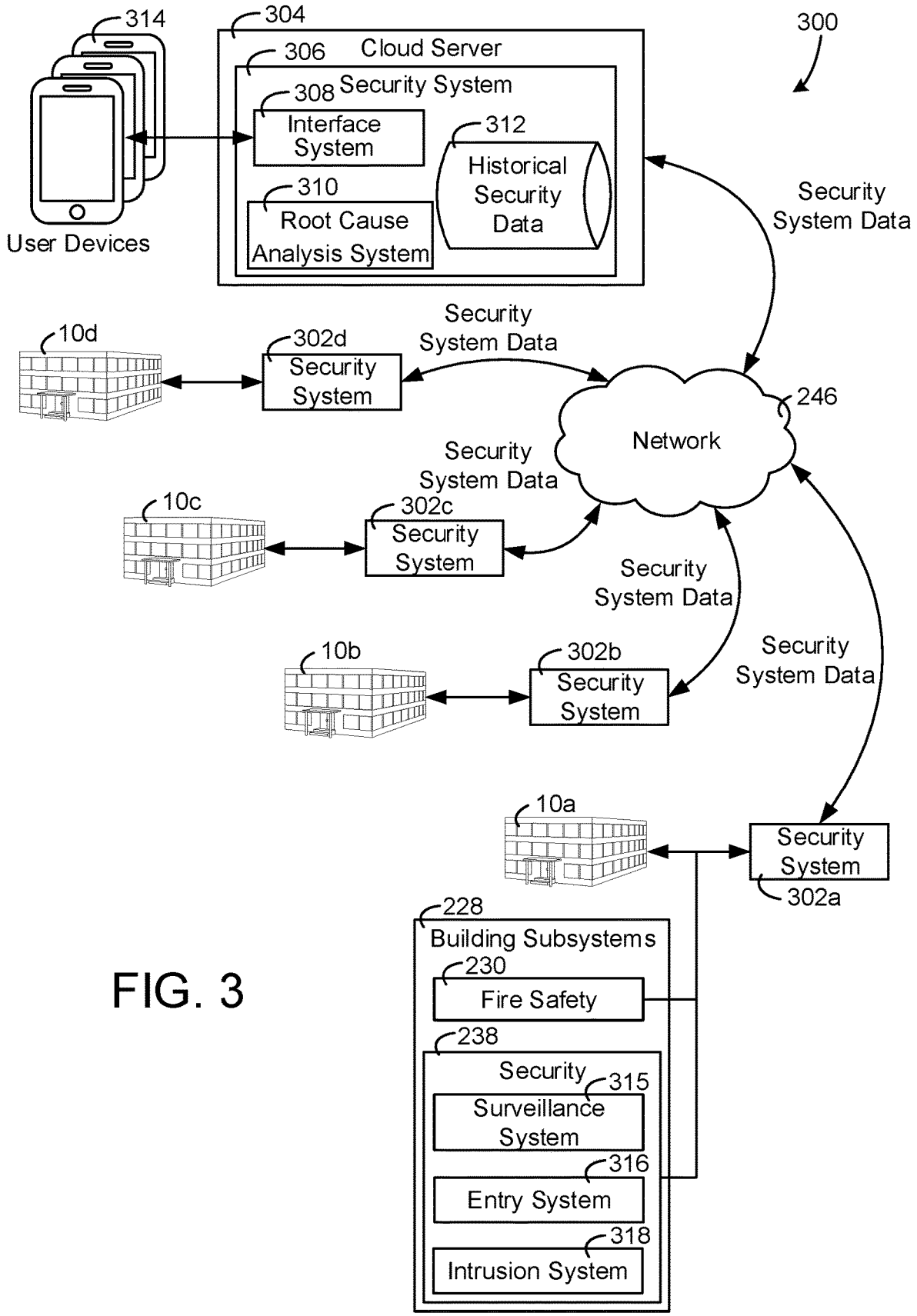
FIG. 3 is a block diagram of building security systems for multiple buildings communicating with a cloud based security system, according to an exemplary embodiment.

Referring now to FIG. 3, a security system 300 is shown for multiple buildings, according to an exemplary embodiment. The security system 300 is shown to include buildings 10*a*-10*d*. Each of buildings 10*a*-10*d* is shown to be associated with a security system 302*a*-302*d*. The buildings 10*a*-10*d* may be the same as and/or similar to building 10 as described with reference to FIG. 1. The security systems 302*a*-302*d* may be one or more controllers, servers, and/or computers located in a security panel or part of a central computing system for a building.

The security systems 302*a*-302*d* may communicate with various security sensors that are part of the building subsystems 228. For example, fire safety subsystems 230 may include various smoke sensors and alarm devices, carbon monoxide sensors and alarm devices, etc. The security subsystems 238 are shown to include a surveillance system 315, an entry system 316, and an intrusion system 318. The surveillance system 315 may include various video cameras, still image cameras, and image and video processing systems for monitoring various rooms, hallways, parking lots, the exterior of a building, the roof of the building, etc. The entry system 316 can include one or more systems configured to allow users to enter and exit the building (e.g., door sensors, turnstiles, gated entries, badge systems, etc.) The intrusion system 318 may include one or more sensors configured to identify whether a window or door has been forced open. The intrusion system 318 can include a keypad module for arming and/or disarming a security system and various motion sensors (e.g., IR, PIR, etc.) configured to detect motion in various zones of the building 10*a*.

Each of buildings 10*a*-10*d* may be located in various cities, states, and/or countries across the world. There may be any number of buildings 10*a*-10*b*. The buildings 10*a*-10*b* may be owned and operated by one or more entities. For example, a grocery store entity may own and operate buildings 10*a*-10*d* in a particular geographic state. The security systems 302*a*-302*d* may record data from the building subsystems 228 and communicate collected security system data to the cloud server 304.

The cloud server 304 is shown to include a security system 306 that receives the security system data from the security systems 302*a*-302*d* of the buildings 10*a*-10*d*. The cloud server 304 may include one or more processing circuits (e.g., memory devices, processors, databases) configured to perform the various functionalities described herein. The processing circuits may be the same and/or similar to the processing circuit 204, the processor 206, and/or the memory 208 as described with reference to FIG. 2. The cloud server 304 may be a private server. In some embodiments, the cloud server 304 is implemented by a cloud system, examples of which include AMAZON WEB SERVICES® (AWS) and MICROSOFT AZURE®.

In some embodiments, the cloud server 304 can be located on premises within one of the buildings 10*a*-10*d*. For example, a user may wish that their security, fire, or HVAC data remain confidential and have a lower risk of being compromised. In such an instance, the cloud server 304 may be located on-premises instead of within an off-premises cloud platform.

The security system 306 may implement an interface system 308, a root cause analysis system 310, and a database 312 storing historical security data, security system data collected from the security systems 302*a*-302*d*. The interface system 308 may provide various interfaces of user devices 314 for monitoring and/or controlling the security systems 302*a*-302*d* of the buildings 10*a*-10*d*. The interfaces may include various maps, alarm information, maintenance ordering systems, etc.

Security systems, e.g., the security system 302*a*, can protect residential or commercial premises by implementing functionality e.g., intrusion detection, access control, video surveillance, and fire detection. In each case, sensors deployed at various locations in and around the building transmit data back to a central system for analysis, e.g., the security systems 302*a*-302*d*. In some instances, such data is further transmitted to an offsite location that serves as a monitoring center, e.g., the root cause analysis system 310. In either case, the sensor data can be analyzed to determine if a condition exists at the premises that requires attention by a security professional. For example, if a motion sensor detects that someone has entered a building at a time that the intrusion system is armed or if an access control system detects that a door is being forced open, that information is transmitted to the local or remote monitoring center which can deploy security guards or call the police.

Unfortunately, such security systems for detecting alarms (e.g., a fire, an intrusion, etc.) may not be foolproof. If a sensor is going bad or requires maintenance, it may produce spurious data falsely indicating that there has been a security breach. For example, a smoke detector may indicate the presence of smoke in the building when it is simply an accumulation of dust on the device. Likewise, a contact switch on a warehouse door may indicate that the door has been opened when, in fact, the magnetic switch has simply stopped working correctly. Such false alarm situations can be numerous and can cost building owners a substantial amount of money each year in business down-time, security agency response fees, and maintenance personnel truck rolls.

In many instances, multiple false alarms can be triggered at the same time or in close temporal proximity to each other as a result of a single triggering event or problem, or root cause. Often, when a false alarm is triggered, data can be sent to a monitor indicating what caused the false alarm, such as, but not limited to, dust on a smoke detector, low battery, a door left open too long, etc. However, when multiple false alarms are triggered, it can be difficult to determine the cause of the false alarms because each false alarm can indicate a possible cause of all of the false alarms. For example, a first false alarm can be triggered indicating that a sensor experienced a power failure. The first false alarm can be closely followed by a second false alarm triggered because the sensor incorrectly sensed a spike in data. Finally, a third false alarm can be triggered resulting from the sensor having low battery. Each cause of these false alarms could also be a cause of the other false alarms and leave technicians guessing at the root cause of the string of false alarms and what action to take to prevent future false alarms.

To help technicians determine the root cause of multiple false alarms, security system 306 includes root cause analysis system 310, in some embodiments. In some embodiments, root cause analysis system 310 is configured to determine a root cause of multiple false alarms that are triggered in sequence with each other. In some embodiments, sensor data from commercial security products (e.g., the building subsystems 228 and/or the security system 302*a*) is monitored by root cause analysis system 310 and used to determine the root cause of multiple false alarms. Based on the determined root cause, root cause analysis system 310 can be configured to generate a recommendation to send to user devices 314 indicating the determined root cause and a recommendation on what action to take to avoid future false alarms based on the determined root cause.

Root cause analysis system 310 can determine the root cause of multiple false alarms by identifying events that caused the false alarms as a sequence of events and determining a rule that applies to the sequence of events. Rules may be stored in a database within security system 306 or root cause analysis system 310 and can indicate a root cause of a string of false alarms based on underlying causes of each false alarms satisfying associated rule criteria. There can be any number of rules based on any rule criteria. For example, a rule may indicate that the underlying cause of a string of false alarms related to a smoke alarm is the smoke alarm is out of battery when a first false alarm is triggered with data indicating the false alarm was triggered by a power outage, a second false alarm is triggered with data indicating the smoke alarm is low on battery, and a third false alarm is triggered with data indicating the smoke alarm detected dust as smoke. The rule criteria may be satisfied by the false alarms being triggered in sequential order, or may further include that the false alarms occur within a time-domain threshold. The time-domain threshold may be user selected or learned based on historical data associated with false alarms triggered as a result of a low smoke detector battery.

In some instances, multiple false alarms being triggered can result in criteria for multiple rules being satisfied. In these instances, root cause analysis system 310 can determine a root cause for the false alarms based on classifications of the rules. Each rule can be classified based on a likelihood that an associated root cause is the root cause of the events (e.g. some root causes occur more often than other so it they can be classified higher). Continuing with the example above, criteria may be satisfied for both a rule that requires a false alarm to be triggered based on a power outage and another false alarm to be triggered based on the smoke detector detecting dust as smoke and another rule that requires the power outage related false alarm and a false alarm triggered by a low battery in the smoke detector. Each rule can be classified, or ranked, and root cause analysis system 310 can determine which satisfied rule is associated with the root cause of the false alarms based on which satisfied rule has the highest classification.

In some embodiments, root cause analysis system 310 is configured to analyze the historical security data stored in security database 312 to determine rules and classifications for the rules. The historical security data can include a history of false alarms and root causes determined to be the cause of the false alarms based on rules. The historical security data can also indicate that particular patterns of false alarms (e.g., a false alarm caused by a low battery and a false alarm caused by a power outage occurring in sequential order, etc.) at the security systems 302*a*-302*d* are indicative of specific root causes that causes the false alarms for each pattern of false alarms. Furthermore, the historical security data can indicate how often criteria for each rule is met so root cause analysis system 310 can automatically classify each rule accordingly. For example, if the criteria for one rule is satisfied more often than the criteria for another rule, root cause analysis system 310 can classify the rule with the criteria that is met more often with a higher level than the other rule. Consequently, root cause analysis system 310 can generate a hierarchical relationship between the rules that can be used when multiple false alarms are triggered to determine the root cause of the false alarms.

Figure 4:
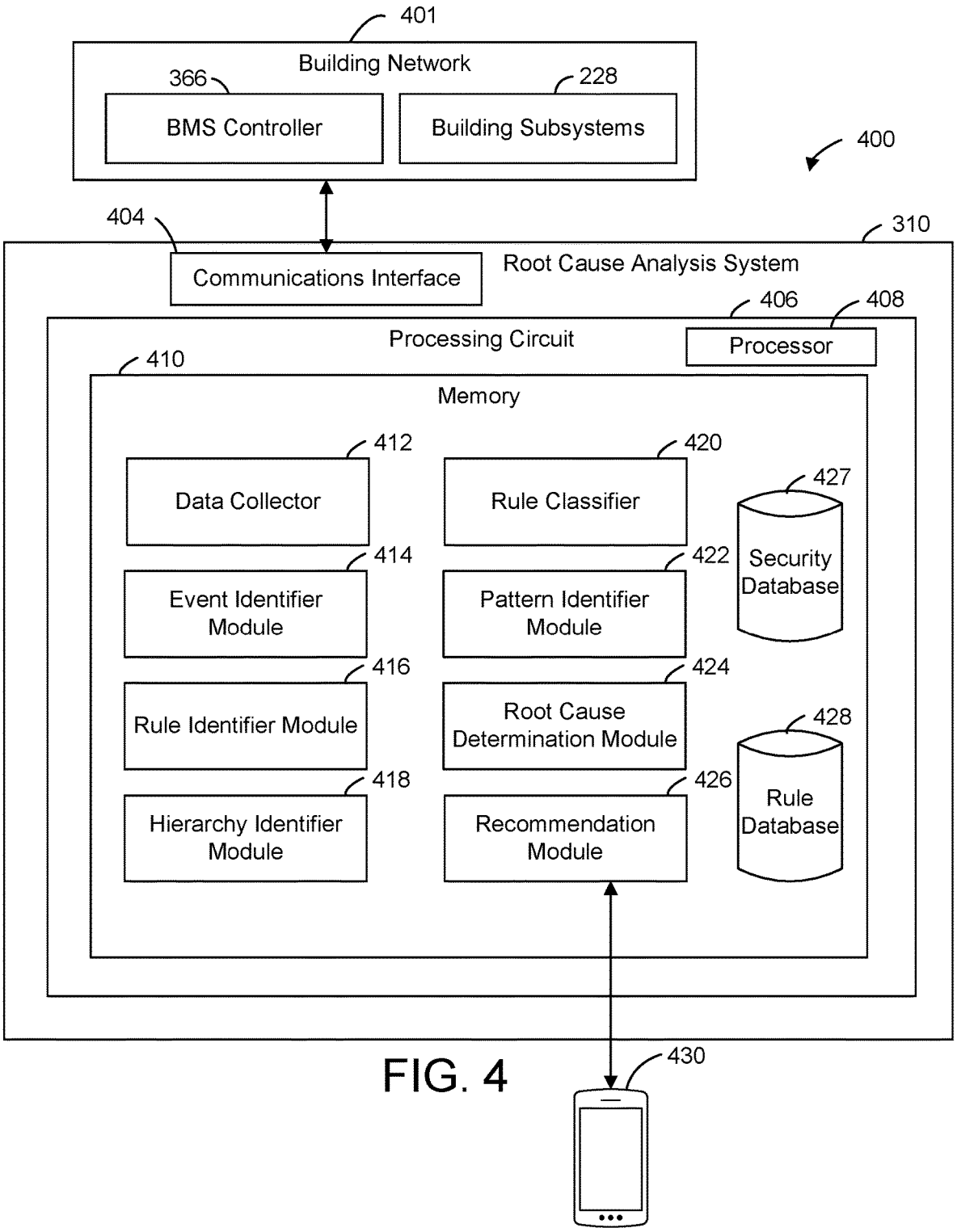
FIG. 4 is a block diagram of a cloud implemented root cause analysis system for analyzing event data to determine the root cause of multiple false alarms, according to an exemplary embodiment.

Referring now to FIG. 4, a block diagram of a system 400 including building network 401 in communication with root cause analysis system 310 as described with reference to FIG. 3 is shown, according to an exemplary embodiment. Building network 401 can include BMS controller 366, building subsystems 228, and/or any items of a building that root cause analysis system 310 can be associated with. Root cause analysis system 310 can be configured to identify a root cause of multiple alarms set off within any given time period based on event data reported by the security system 302*a* or building network 401. In some embodiments, root cause analysis system 310 can also determine the root cause of one alarm being set off. Root cause analysis system 310 is shown to include a processing circuit 406 that includes a processor 408 and a memory 410. Memory 410 can include instructions which, when executed by processor 408, cause processor 408 to perform the one or more functions described herein. Processor 408 may be the same and/or similar to the processor 206 as described with reference to FIG. 2 and memory 410 may be the same as and/or similar to memory 208 as described with reference to FIG. 2. Each of the processes and services conducted by root cause analysis system 310 can also be conducted by BMS controller 366. In some embodiments, each of the processes and services conducted by root cause analysis system 310 can be implemented in cloud 304, shown in described with reference to FIG. 3, or particularly within alarm analysis system 310.

In addition to a traditional processor and memory, processing circuit 406 may include integrated circuitry for processing and/or control, e.g., one or more processors and/or processor cores (e.g., microprocessor and/or microcontroller) and/or FPGAs (Field Programmable Gate Array) and/or ASICs (Application Specific Integrated Circuitry). Processing circuit 406 can include and/or be connected to and/or be configured for accessing (e.g., writing to and/or reading from) the memory 506, which may include any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory).

Memory 410 can be configured to store code executable by control circuitry and/or other data, e.g., data pertaining to communication, e.g., configuration and/or address data of nodes, etc. Processing circuit 406 can be configured to implement any of the methods described herein and/or to cause such methods to be performed, e.g., by processor 408. Corresponding instructions may be stored in memory 410, which may be readable and/or readably connected to the processing circuit 406. Memory 410 is shown to include a data collector 412, an event identifier module 414, a rule identifier module 416, a rule classifier 420, a root cause determination module 424, a recommendation module 426, a security database 427, and a rule database 428. Processing circuit 406 can implement any of components 412-428 to identify false alarms, identify rules associated with the false alarms, determine if criteria of the rules are satisfied by the identified false alarms and false alarm data, determine a root cause of the false alarms, and generate a recommendation based on which rule is associated with the determined root cause. It may be considered that processing circuit 406 includes or may be connected or connectable to memory 410, which may be configured to be accessible for reading and/or writing by the controller and/or processing circuit 406.

Root cause analysis system 310 is shown to include a communication interface 404. Communication interface 404 can be configured to facilitate communication with a user device 430, security system 302*a*, devices of building network 401, and/or any other device. Furthermore, communication interface 404 can be configured to communicate with all of the devices and systems described with reference to FIG. 3.

Via the communication interface 404, security database 427 can be configured to receive (collect) security system data from the security system 302*a*. The security system data can include events such as an occurrence detected by a sensor of the security system 302*a*. For example, an intrusion sensor may identify that an individual is trying to force a window open. Another event can be a sensor detecting dust as smoke, triggering an alarm and calling a police dispatch. Further another event can be a ground fault that triggered an alarm. The events can further include signals. For example, a signal may be a continuous signal of a door being opened and a door being closed.

In some embodiments, events of the security system data also include events that cause alarms to be raised resulting in a police dispatch. When an event, such as an occurrence detected by a sensor, occurs, root cause analysis system 310 and/or security system 302 can set off an alarm that results in a call for a police dispatch. To do so, root cause analysis system 310 and/or security system 302 can send a signal to a police department with an alarm number or code indicating that a police dispatch is needed and a reason for the police dispatch. Unfortunately, in some instances, alarms can be triggered for events unrelated to any security purpose, such as, but not limited to, a power failure of a device, a ground fault, low battery, user error, etc. In these instances, the events and the associated false alarms can be logged and analyzed by components 412-428 of root cause analysis system 310 and a signal can be transmitted to a police station indicating for a police dispatch, even though the alarm was triggered based on a mechanical defect and/or user error and the police are not needed.

Referring still to FIG. 4, data collector 412 includes programmed instructions executed by one or more servers or processors (e.g., processing circuit 406), in some embodiments. Data collector 412 can be configured to retrieve and/or collect data sent from building network 401 and/or security system 302 and store the data in security database 427. Data collector 412 can be configured to collect data automatically after receiving a notification from security system 310 indicating that one or more alarms caused a police dispatch to be called. In some embodiments, data collector 412 can be configured to collect security data associated with the alarm, including, but not limited to, how many alarms were triggered, what event triggered each alarm, when each alarm was triggered, etc. Data collector 412 can be configured to tag the data with time stamp tags that indicate when the events and alarms occurred and/or when data collector 412 collects the data. Data collector 412 can also be configured to store the tagged data in security database 427 to be analyzed by event identifier module 414. In some embodiments, data collector 412 can be configured to collect the data from building network 401 and/or security system 302 upon receiving a request from a user device requesting data related to events that cause alarms and police dispatches. In some embodiments, data collector 412 can be configured to receive events of building data at pre-selected time periods.

Event identifier module 414 includes programmed instructions executed by one or more servers or processors (e.g., processing circuit 406), in some embodiments. Event identifier module 414 can be configured to identify events that caused an alarm to be raised and a police dispatch called along with characteristics of the events. After one or more false alarms have been raised and data collector 412 can be configured to collect the data related to the events that caused the one or more false alarms, event identifier module 414 can be configured to parse through the data to identify which event caused which alarm and at what time the event and/or alarm occurred. In some embodiments, event identifier module 414 can be configured to identify what each event is based on a string associated with each event in the data. For example, a "low battery" event may be identified in a string by data collector 412 as low battery when data collector 412 receives the data. Event identifier module 414 can be configured to identify the low battery string from a database within root cause analysis system 310 that holds different possible events. In some embodiments, the database is security database 427. Event identifier 414 can identify low battery as an event that caused a false alarm and identify what time low battery occurred based on an associated time stamp. Event identifier 414 can be configured to identify any number of events and time stamps associated with the events.

Rule identifier module 416 includes programmed instructions executed by one or more servers or processors (e.g., processing circuit 406), in some embodiments. Rule identifier module 416 can be configured to identify rules to apply to the identified events and/or false alarms to determine a root cause of the events and/or false alarms. Rule identifier module 416 can be configured to identify rules from rule database 428 based on events identified by event identifier module 414. For example, event identifier 414 can be configured to identify a string of four events that each cause a different false alarm and times that each of the events occurred. Rule identifier module 416 can be configured to receive the identified events and apply rules to the four events to determine if criteria for a rule within rule database 428 is satisfied, rule identifier module 416 can be configured to identify the rule. In some embodiments, rule identifier module 416 can be configured to identify multiple rules that are satisfied by a single sequence of events and that each have different criteria. A rule can be satisfied if criteria of the rule is satisfied.

Rule database 428 can be a dynamic database including data inputs that data collector 412 receives from building network 401. Rule database 428 can be a graph database, MySQL, Oracle, Microsoft SQL, PostgreSq1, DB2, document store, search engine, key-value store, etc. Rule database 428 is configured hold any amount of data and can be made up of any number of components, in some embodiments. Rule database 428 can store rules used to determine root causes of sequences of events that cause police dispatches. Rule database 428 can hold any number of rules. Rules can be added or removed from rule database 428 at any time.

Rules in rule database 428 that are identified by rule identifier module 416 can include criteria associated with different events that can be met for the rule to be satisfied. The criteria can be associated with specific events that need to occur, a sequential order the events need to occur in, a time threshold that the events need to occur within, etc. For example, criteria of a rule can require that a first event indicating that smoke detector detect smoke (but has really only sensed dust) and a second event indicating a low battery signal occur within five minutes of each other for the criteria to be satisfied. Causes of each false alarm can be events, in some embodiments. The criteria could also require that each event set off an individual false alarm. Further, the criteria could require the two events to occur in a particular sequential order (e.g., the first event followed by the second event or the second event followed by the first event). The criteria can include one or more time thresholds indicating a time period which a second event must occur after a first event for the criteria to be satisfied. There can be any number of events associated with a rule criteria and time thresholds can be of any duration.

In some embodiments, for rule identifier module 416 to identify events and event sequences that satisfy rules or rule database 428, rule identifier module 416 can be configured to repeatedly search the events in an event log that meet criteria of a rule. Rule identifier module 416 can be configured to search the event log rule by rule to determine which rule is satisfied. In some embodiments, to search for events that satisfy criteria of a rule, rule identifier module 416 can be configured to search for a first event of an event sequence of the rule criteria. If rule identifier module 416 identifies the first event in the event log, rule identifier module 416 can be configured to search for a second event of the event pattern and continue to search for events until finding each event of the event pattern. If rule identifier module 416 fails to find an event in an event pattern of a rule, rule identifier module 416 can be configured to stop searching for events associated with the rule and event pattern and repeat the process for another rule. Rule identifier module 416 can be configured repeat the process for every rule in rule database 428 to identify rules with satisfied criteria.

In some embodiments, in addition to identifying events that satisfy event pattern criteria of multiple rules, rule identifier module 416 can be configured to identify whether the events that occur in a sequence of events that fit into event patterns of different rules also fall within time thresholds associated with each rule. For the rules associated both with time thresholds and event patterns, rule identifier module 416 can be configured to determine that one event of an event pattern occurs within a predefined length of time of another event occurring for the rules to be satisfied.

In some embodiments, rules in rule database 428 are associated with a classification, or classification level. The classification is determined by rule classifier 420 or selected by a user at user device 430 as discussed below, in some embodiments. Classifications can identify a position of a rule within a hierarchical relationship and represent a ranking or classification level for each rule. If the criteria for multiple rules are satisfied based on a single sequence of events, rule identifier module 416 can be configured to identify which rule to select as being associated with a root cause of the sequence of events based on which rule has the highest classification. Rules can be tagged with classification tags including numbers that represent the classification of each rule in relation to other rules.

Rule identifier module 416 can be configured to identify classifications of rules with satisfied criteria by scanning each rule for a classification tag. Rule identifier module 416 can be configured to identify the classification of each rule based on the classification tag of each rule. Rule identifier module 416 can be configured to then compare the identified classification tags to each other determine which rule is associated with a highest classification. Rule identifier module 416 can be configured to determine which rule is associated with a root cause of a sequence of events based on the classification tags of each rule. The satisfied rule that is associated with the highest classification can be associated with the root cause of a sequence of events indicating a root cause of a false alarm. Rule identifier module 416 can be configured to send determined rules to root cause determination module 424, which can be configured to determine a root cause associated with the determined rules.

In some embodiments, each rule in rule database 428 is associated with a root cause. Rules of rule database 428 can be tagged with identifiers identifying root causes associated with each rule. A root cause is representative of a cause of the events that caused one or more false alarms and a subsequent police dispatch, in some embodiments. While a security system may indicate a separate cause for each event that caused a false alarm, there may be a root cause that caused a sequence of events, even if some events in the sequence are indicated to be associated with a different root cause. Root causes associated with rules can be determined by root cause determination module 424. Examples of root causes associated with rules include, but are not limited to, bad glass-break detecting, camera not connecting, early open, employee needs PIC code, entry delay, exit delay, expansion module, failed timer test, ground fault, low battery, bad motion sensing, site not contactable, site not closed on schedule, site not opened on schedule, etc. Each rule can be associated with a solution group, such as, but not limited to, programming, hardware failure, system usage, etc.

Root cause determination module 424 includes programmed instructions executed by one or more servers or processors (e.g., processing circuit 406), in some embodiments. Root cause determination module 424 can be configured to identify a root cause that resulted in one or more false alarms. Root cause determination module 424 can be configured to determine the root cause by identifying a satisfied rule determined to have the highest classification of the satisfied rules by rule identifier module 416. Root cause determination module 424 can be configured to identify the root cause associated with the rule by scanning the rule for a tag indicating the root cause associated with a sequence of events.

In addition to identifying a root cause associated with a rule with the highest classification, root cause determination module 424 can be configured to identify an action that can be taken to repair the root cause. Each root cause can be associated with an action that a technician and/or a self-healing system can take to repair the root cause. Examples of actions a technician can take include, but are not limited to, replacing the battery of a device, changing the configuration of a device, repairing a defective power line, repairing a defective device, reprogramming a device, etc. Actions the self-healing system can take include, but are not limited to, changing configuration parameters of building devices. Actions can be tagged with rules or tags of root causes. Root cause determination module 424 can be configured to identify actions by scanning the rules or root causes for tags indicating an associated action. In some embodiments, instead of using tags, root causes can be matched with actions in a table within rule database 428. Root cause determination module 424 can be configured to identify which root cause was determined to be a cause of a sequence of events and match the root cause with the action in the table. Root cause determination module 424 can be configured to send an identified root cause to recommendation module 426, which can be configured to transmit the root cause and action data to an external device.

In some embodiments, actions are classified in a hierarchical relationship. In these embodiments, instead of identifying classifications of rules to determine a root cause of a sequence of events, rule identifier module 416 can be configured to identify an action that is associated with a satisfied rule, the satisfied rule being associated with a highest classification level of the of multiple different satisfied rules. Root causes can be associated with the actions. Root cause determination module 424 can be configured to determine which root cause is the cause of a sequence of events based on which root cause is associated with an action identified by rule identifier module 416 to be associated with a satisfied rule and has the highest classification.

Recommendation module 426 includes programmed instructions executed by one or more servers or processors (e.g., processing circuit 406), in some embodiments. Recommendation module 426 can be configured to generate an action recommendation that can be implemented to repair a root cause that resulted in a false alarm or multiple false alarms and transmit the action recommendation to an external user device, such as, but not limited to, user device 430. Recommendation module 426 can be configured to generate the action recommendation by identifying the action and root cause determined by root cause determination module 424 and identifying a template based on the action and root cause. The template can have instructions detailing what action or actions to take to repair one or more root causes of a sequence of events. Each action and root cause combination can be associated with a template in a database within root cause analysis system 310.

To generate a recommendation, recommendation module 426 can be configured to identify a template associated with an action and root cause within the database and input data into the template identifying facts specific to the sequence of events associated with the action and root cause (e.g. what events occurred, where the events occurred, when the events occurred, etc.). After generating the action recommendation, recommendation module 426 can be configured to transmit the action recommendation to a third party, such as a technician, including instructions detailing how to fix the root cause. In some embodiments, recommendation module 426 can be configured to determine that a self-healing system can repair the root cause based on data in a database indicating that specific actions can be handled by the self-healing system. If recommendation module 426 makes this determination, recommendation module 426 can be configured to send instructions to a processor of the self-healing system detailing the root cause and actions to take to repair the root cause.

Referring still to FIG. 4, rule classifier 420 includes instructions performed by one or more servers or processors (e.g., processing circuit 406), in some embodiments. Rule classifier 420 can be configured to determine classifications for each rule in a hierarchical relationship. Rule classifier 420 can be configured to determine a classification for each rule in rule database 428 and tag each rule with an associated classification. Rule classifier 420 can be configured to determine the classifications based on historical data within security database 427. The historical data can include previous sequences of events that occurred that resulted in false alarms and a subsequent police dispatch. The historical data can be specific to the building or based on historical data of similar buildings to obtain the most accurate prediction. In some embodiments, every time a police dispatch is called, the events leading up to the police dispatch are stored in security database 427 along with time stamps indicating a day and time that the events happened. Rule classifier 420 can be configured to parse through the historical data to determine which root cause is most likely to be a cause for a sequence of events and rank rules and/or actions accordingly.

Rule classifier 420 can be configured to determine which root cause is most likely to be a cause for a sequence of events by identifying how many times a rule is determined to be associated with a root cause determined to be a cause of a sequence of events. In some embodiments, rule classifier 420 can be configured to create counters associated with each rule. Rule classifier 420 can be configured to parse through the historical data in security database 427 to identify every instance that a rule is determined to be associated with a root cause and add to the counter for each instance. Rule classifier 420 can be configured to compare the counters associated with each rule and classify, or rank, each rule based on which rule has the highest counter. In some embodiments, rule classifier 420 can be configured to update rule classifications in real-time, so in addition to using historical data, rule classifier 420 can be configured to add to a rule counter every time rule identifier module 416 determines a rule is associated with a root cause of a sequence of events. In some embodiments, instead of automatically generating classifications for each rule, a human can manually identify classifications for each rule and rule classifier 420 can be configured to update the classifications of each rule based on the human input.

Figure 5:
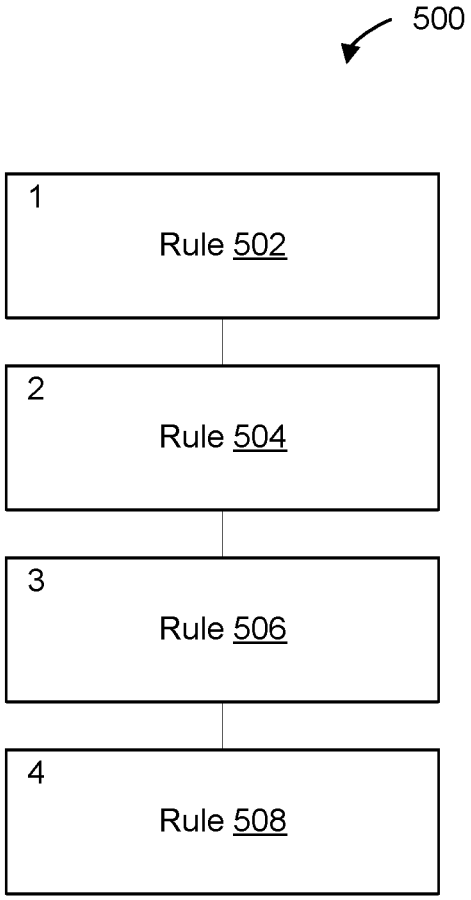
FIG. 5 is a block diagram of a relationship hierarchy including rules and classifications for the rules, according to an exemplary embodiment.

Referring now to FIG. 5, a block diagram of a relationship hierarchy 500 including rules and classifications for the rules is shown, according to an exemplary embodiment. Relationship hierarchy 500 is shown to include rule 502, rule 504, rule 506, and rule 508. Each rule 502-508 in relationship hierarchy 500 can be associated with a root cause. Although four rules are shown in FIG. 5, the relationship hierarchy 500 can include any number of rules. In some embodiments, each rule can be associated with one or multiple root causes. In some embodiments, multiple rules can be associated with the same root cause.

Rule 502 is shown to be on the top of relationship hierarchy 500 while rule 508 is shown to be on the bottom relationship hierarchy 500. The position of the rules 502-508 within the relationship hierarchy 500 can be predefined or can be updated over time. When a sequence of events satisfies multiple rules, the root cause determination module 424 can be configured to select one of the satisfied rules based on the position of the rule within the relationship hierarchy 500. Classification levels for each rule in relation to each other are shown in the top left corner of each rule, i.e., 1, 2, 3, and 4. The classification levels can define which rule of the rules 502-508 is selected when multiple of the rules 502-508 are triggered. For example, if false alarms were set off in a sequence and within a time frame that satisfied criteria for both rule 502 and rule 508, root cause analysis system 310 can select the rule with the highest classification level, i.e., rule 502. The selected rule can be the rule associated with the root cause of the sequence of false alarms that the recommendation module 426 is configured to generate an action recommendation based on the root cause associated with rule 502, in some embodiments.

Advantageously, by using a relationship hierarchy such as relationship hierarchy 500, root cause analysis system 310 can be prepared for a high number of false alarms triggering in sequence within a small time frame. This is especially useful in a scene where seemingly unrelated false alarms are triggered that cause criteria for multiple rules to be satisfied, each rule being associated with a different root cause. Root cause analysis system 310 can quickly and easily determine which rule is associated with a correct root cause using the hierarchical relationship and disregard the other rules with satisfied criteria.

Figure 6:
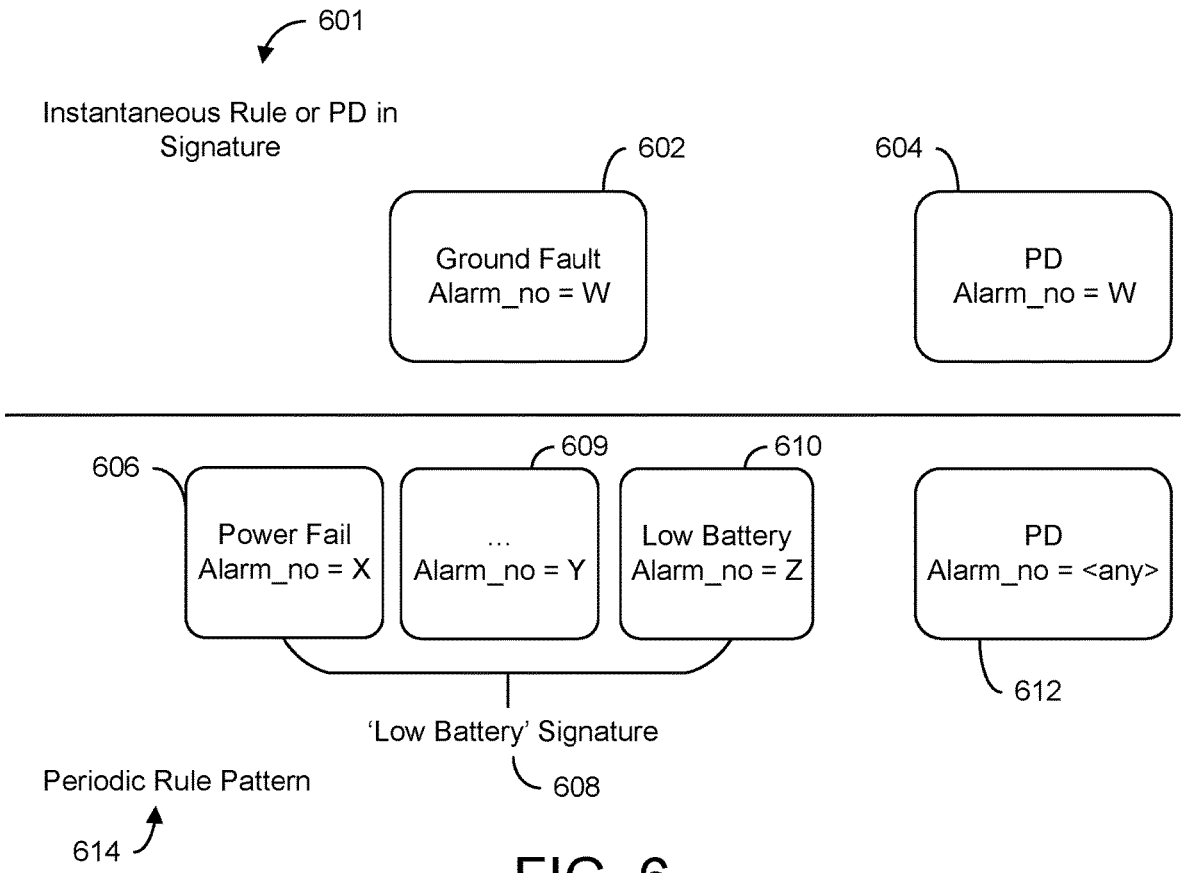
FIG. 6 is a block diagram of two sequences that cause a police dispatch, one sequence including one event and the other sequence including multiple events, according to an exemplary embodiment.

Referring now to FIG. 6, a block diagram of two sequences that cause a police dispatch that define two different types of rules are shown, according to an exemplary embodiment. One sequence, defining an instantaneous rule 601, includes one event, in some embodiments. The other sequence, defining a periodic rule pattern 614, includes multiple events is shown, in some embodiments. Each sequence is an example sequence of possible events that cause false alarms resulting in a police dispatch. Each sequence can include any number of events and police dispatches and can include any type of event that causes a false alarm. Instantaneous rule 601 is shown to include a ground fault 602, which causes a police dispatch 604. Periodic rule pattern 614 is shown to include a rule 608, and a police dispatch 612.

Instantaneous rule 601 is an example rule with criteria that only includes one event occurring to be satisfied, in some embodiments. For criteria of instantaneous rule 601 to be satisfied, only ground fault 602 needs to occur. It should be understood that rules that only require one event to occur to be satisfied, such as instantaneous rule 601, can require any event to occur. Ground fault 602 is associated with alarm number "W", in some embodiments. When an alarm is raised by one event, such as, but not limited to, ground fault 602, a signal can be sent to root cause analysis system 310 indicating an alarm number associated with ground fault 602, or W as shown in FIG. 6. In some instances, when one event occurs to cause a false alarm and satisfy criteria of a rule without any accompanying events, root cause analysis system 310 can identify a root cause of the event because only one rule is satisfied and consequently there is only one potential root cause. Thus, root cause analysis system 310 can identify the potential root cause and send an action recommendation to an external user device indicating what action to take based on the one event occurring and satisfying criteria of a rule.

Periodic rule pattern 614 includes a rule 608 and a police dispatch 612, in some embodiments. Example rule 608 requires multiple events to occur to be satisfied and for a police dispatch to be called, in some embodiments. It should be understood that rules that require multiple events to occur can require any events to occur. Periodic rule pattern 614 can represent an instance where multiple events that cause false alarms to occur that result in police dispatch 612. The events can satisfy criteria of example rule 608, labelled 'low battery' signature, so root cause analysis system 310 can determine a root cause of the events. The events shown to be included in periodic rule pattern 614 include a power fail 606, an unknown event 609, and a low battery 610. Each of events 606-610 can cause a false alarm and result in police dispatch 612. However, in some instances, if each event occurs within a short period of time, only one police dispatch is called to service the false alarms. In some instances, the police dispatch is only associated with one alarm number representing one false alarm. In these instances, it can be difficult for root cause analysis system 310 and/or a police terminal associated with sending out police dispatches to determine which event and/or false alarm caused the police dispatch, making it difficult to determine a root cause of all of the events, false alarms, and the police dispatch. Consequently, root cause analysis system 310 can, instead of using an alarm code of a police dispatch to determine a root cause, determine if the events resulting in police dispatch 612 satisfy criteria of rule 608 to determine a root cause of the events.

The criteria of rule 608 can be that power fail 606 occurs before low battery 610. In some instances, criteria of 'low battery' signature requires that low battery 610 occur within a predetermined time period from power fail 606 to be satisfied. In some instances, whether any events occur between power fail 606 and low battery 610 does not matter as long as power fail 606 and low battery 610 otherwise satisfy criteria of rule 608. If root cause analysis system 310 determines that criteria of rule 608 has been satisfied, root cause analysis system 310 can determine the root cause of the sequence of events and provide an action recommendation to an external user device for a user to take to solve the root cause.

Figure 7:
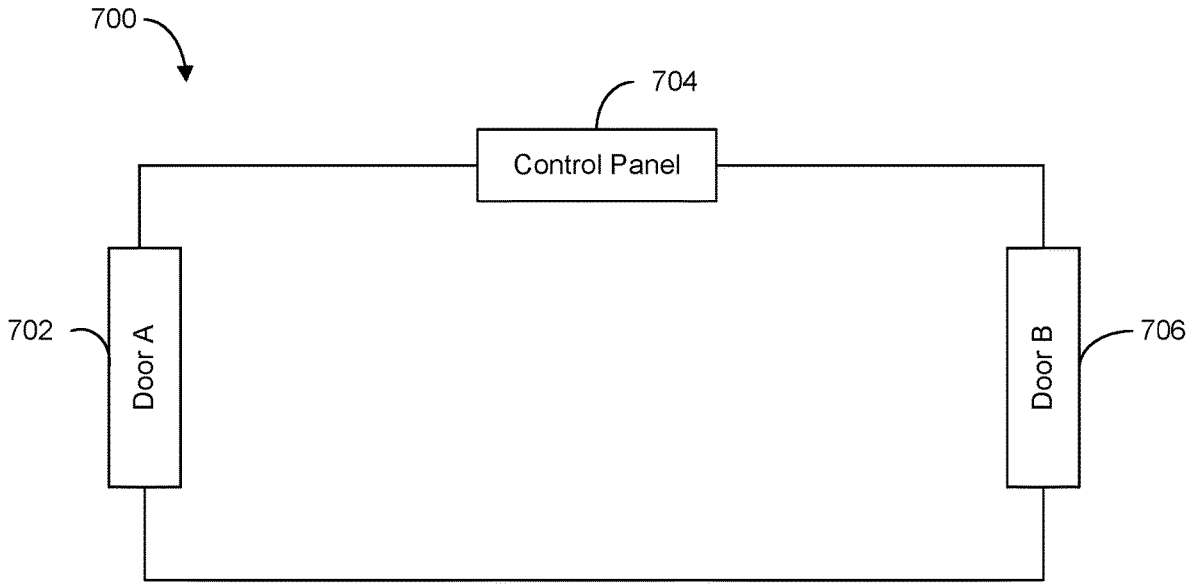
FIG. 7 is a block diagram of doors connected to a control panel in a building, according to an exemplary embodiment.

Referring now to FIG. 7, a block diagram a building 700 having doors 702 and 706 connected to a control panel 704 is shown, according to an exemplary embodiment. Control panel 704 can identify events and false alarms that occur in a time window (e.g., a user defined or predefined time window). Control panel 704 can be the same as, or similar to, root cause analysis system 310.

This can be beneficial when alarms occur at different times, or at the same time, from different doors opening. For example, an alarm may be triggered when door 702 is opened and another alarm may be triggered when door 706 is triggered. If the alarms are triggered within a certain time period, often short, a police dispatch may be called based on solely one of the alarms. Using the system and methods described herein, control panel 704 can use different time thresholds associated with time stamps of the alarms to determine which door opening caused the police dispatch. This can be beneficial to the system (e.g. the system can identify the cause of the false alarm instead of relying on data that could be randomly selected by a police dispatch computer) and determine what the root cause of the false alarms were, such as a person running into building 700 through door 702 to pick up something the person left or forgot and leaving out of door 706.

In another example, control panel 704 can determine the root cause of a sequence of false alarms when a single event occurs multiple times, generating a false alarm each time. In some instances, an event occurring multiple times may be associated with different alarm numbers. For example, a false alarm may be triggered as a result of door 702 opening, the false alarm having an alarm number X. A second false alarm may be triggered as a result of door 702 opening, this false alarm having an alarm number Y. A police dispatch may be called based on either alarm number X or Y. Using the systems and methods described herein, control panel 704 can identify each event and determine that the police dispatch was called as a result of the door opening and that the second alarm may have been a mechanical error. Control panel 704 can make the same determination if the same alarm number X is associated with two false alarms associated with door 702 being open.

In yet another example, control panel 704 determines a root cause of a sequence of events when a false alarm having alarm number X is triggered by door 702 being open, a second false alarm having alarm number Y is triggered by door 706 being open, a third false alarm having alarm number X is triggered as a result of doors 702 and 706 being open, and a fourth false alarm having alarm number Y is triggered as a result of doors 702 and 706 being open. In this example, four false alarms have been triggered and only two alarm numbers have been generated, X and Y. A police dispatch can be called based on only one alarm number, making it difficult to determine which alarm and what caused the police to be dispatched. Using the systems and methods described herein, control panel 704 can identify the cause of the dispatch by using rules having time thresholds associated with lengths of time between each alarm. Consequently, control panel 704 can easily determine which door opening and false alarm caused the police dispatch and how to avoid a future event resulting in a police dispatch.

Figure 8:
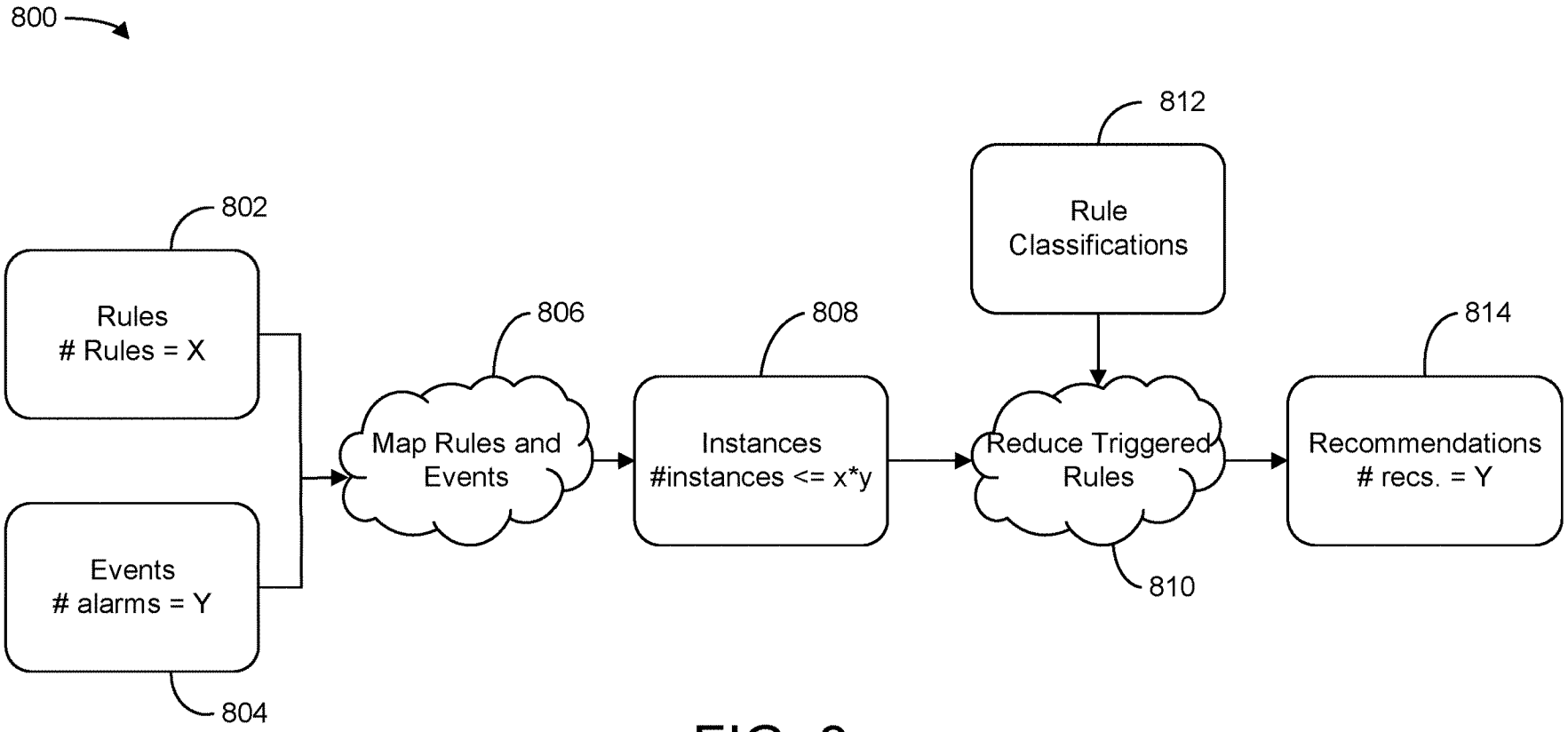
FIG. 8 is a block diagram of a work flow for mapping rules to events and determining recommendations based on the mapped rules to events, according to an exemplary embodiment.

Referring now to FIG. 8, a block diagram of a workflow 800 for mapping rules 802 to events 804 and determining recommendations based on mapped rules 802 to events 804 is shown, according to an exemplary embodiment. Work flow 800 is shown to include rules 802, events 804, a map 806, instances 808, reduce 810, rule classifications 812, and recommendations 814. The root cause analysis system 310 is configured to perform the workflow 800, in some embodiments. In brief overview, the workflow 800 includes identifying events that cause false alarms and rules associated with the events, mapping the rules to the events to obtain instances, using rule classifications to determine which rule is most likely associated with a root cause of the events, and provide one or more recommendations to an external computer identifying actions to take to avoid future events, in some embodiments.

In response to one or more false alarms go off, root cause analysis system 310 can identify events 804 that are associated with the false alarms. A number of events 804 can be represented by Y in FIG. 8, and there can be any number of events. In some embodiments, each event is associated with an alarm. Root cause analysis system 310 can identify rules 802 associated with events 802. A number of rules 802 can be represented by X in FIG. 8. To identify rules 802, root cause analysis system 310 can identify events 804 and each rule of rules 802 that can be associated with each event. For example, a smoke detector can detect dust as smoke and trigger an alarm. Detecting dust as smoke can be an event and be part of a criteria for any number of rules 802. Root cause analysis system 310 can identify each rule where detecting dust as smoke is an event that is part of the criteria of the rule. Root cause analysis system 310 can identify any number of events and rules associated with the events. In some embodiments, an administrator can establish a time period for when to determine which events 804 to associate with rules 802.

At map rules and events 806, root cause analysis system 310 can determine which rules 802 are satisfied by events 804. Root cause analysis system 310 can determine which rules are satisfied by comparing the criteria of rules associated with each event to the events occurring. If the rules require that events occur within a certain time period, root cause analysis system 310 can identify time stamps associated with each event to determine if the events satisfy criteria of associated rules. Criteria of any number of rules can be satisfied.

In another implementation, to determine which rules of rules 802 are satisfied by events 804, root cause analysis system 310 can create a list including each event of events 804 and run searches associated with criteria of each rule of the list of events 804. The list may include events 804 and time stamps associated with when each event occurred. For example, criteria of rule A of rules 802 can require a pattern of events to occur within a time frame. Root cause analysis system 310 can search the list of events for this rule criteria. Root cause analysis system 310 can search the list of events for patterns and criteria associated with each rule of rules 802 to map rules 802 to events 804.

By mapping events 804 to rules 802, root cause analysis system 310 can determine which rules are satisfied as instances 808. Instances 808 can be the same or similar to satisfied rules. Each instance of instances 808 can be associated with a unique potential action recommendation that root cause analysis system 310 could send to an external device. Potential actions are actions that a person could take to avoid future false alarms stemming from a similar root cause, in some embodiments. Root cause analysis system 310 can provide recommendations to take potential actions based on rules 802 that root cause analysis system 310 determined to be satisfied and that have the highest classification.

At reduce triggered rules 810, root cause analysis system 310 can use rule classifications 812 to determine which action recommendation to send to an external user. Rule classifications 812 can represent a hierarchical relationship between rules and/or action recommendations that represents which action recommendation to send to external users if criteria for more than one rule is satisfied. In some embodiments, rule classifications 812 is the same as, or similar to, the relationship hierarchy 500. The hierarchical relationship can be made up of each rule of rules 802 and be based on classifications associated with each rule. Classifications of each rule can be manually established by an administrator or dynamically established based on which rule is most commonly determined to be associated with a root cause of a sequence of fire alarms. Root cause analysis system 310 can base the classification of each rule in the hierarchy on the number of times each rule is determined to be associated with a root cause of a sequence of alarms.

Recommendations 814 represents an action recommendation or recommendations that root cause analysis system 310 can generate and/or send to an external device based on which satisfied rule has the highest classification. In some embodiments, rules of rules 802 are associated with multiple action recommendations to solve a root cause. Rules associated with multiple action recommendations can be complex issues that require multiple fixes, such as, but not limited to, a faulty power line and a smoke detector with a low battery. Root cause analysis system 310 can identify both issues as needing to be fixed to solve the root cause of a sequence of false alarms and to avoid future false alarms. Thus, a rule associated with the root cause can be associated with action recommendations replace the smoke detector and repair the power line.

Figure 9:
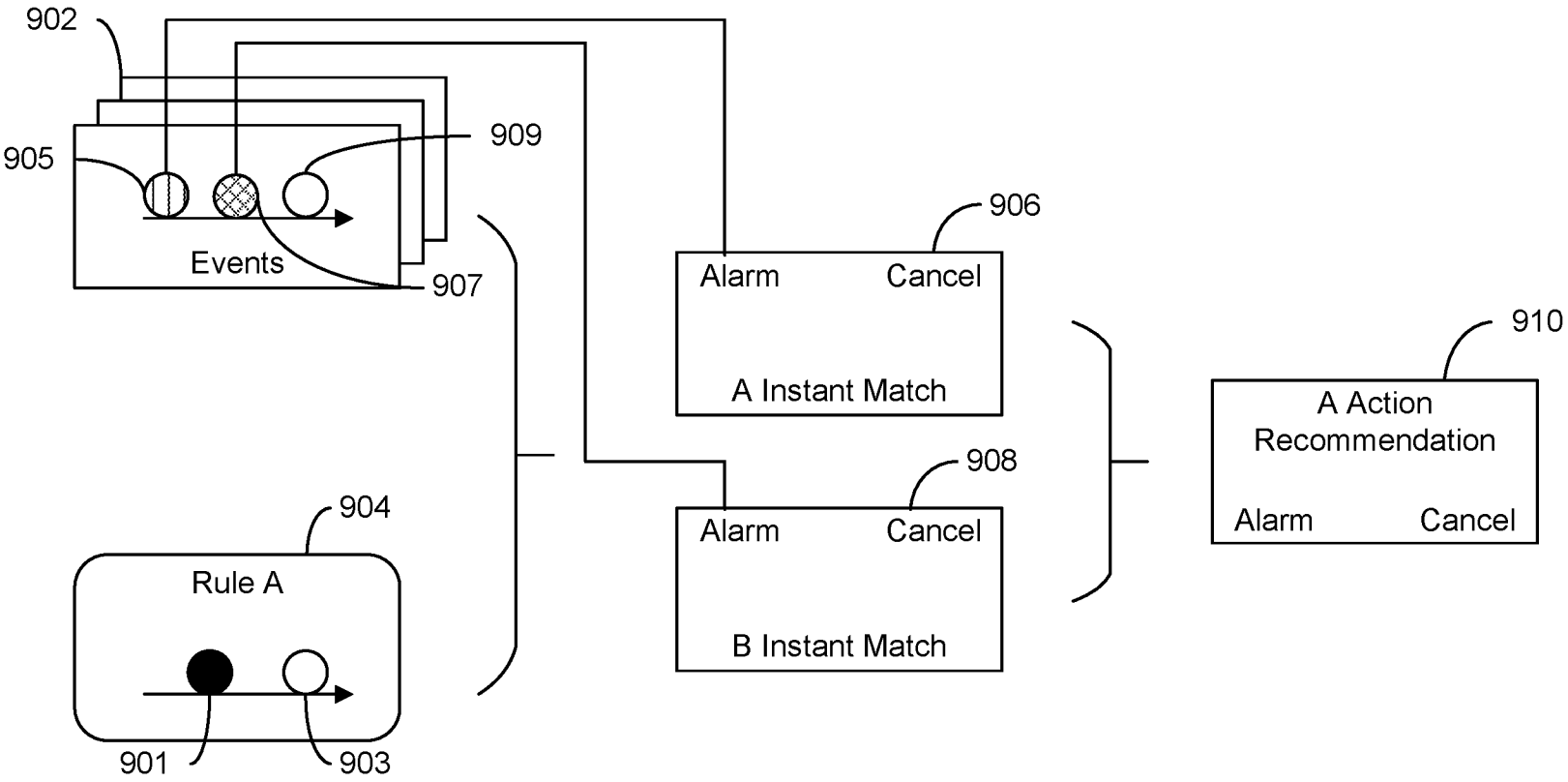
FIG. 9 is a block diagram of a rule pattern being applied to a sequence of events that set off alarms to generate an action recommendation, according to an exemplary embodiment.

Referring now to FIG. 9, a flow diagram of a rule 904 being applied to a sequence 902 of events 903 and 905 that set off alarms to generate an action recommendation 910 is shown, according to an exemplary embodiment. Root cause analysis system 310 can search for criteria of rule 904 within sequence 902. If criteria of rule 904 requires that events occur within a specific time period, root cause analysis system 310 can search time stamps associated with each event in addition to searching for events associated with rule 904. Events 905 and 907 are shown to cause instant matches 906 and 908. Based on the alarms, root cause analysis system 310 can generate an action recommendation 910 to send to an external user. In some instances, events 905 and 907 separately satisfy criteria of rule 904. Consequently, root cause analysis system 310 can identify that the same rule was satisfied twice by one sequence of events. In these instances, root cause analysis system 310 can identify that the same rule was satisfied twice and treat the rule as being satisfied once when determining if the rule has a highest classification of satisfied rules associated with events 905 and 907. Consequently, root cause analysis system 310 can generate one action recommendation based to repair a root cause that caused events 905 despite recognizing two distinct events.

Rule 904 is shown to include criteria 901 and stop 903. Criteria 901 is representative of any possible sequence or pattern of events occurring within a given time period, in some embodiments. Criteria 901 can include criteria requiring any number of events of any type and that the events happen within any time frame. Stop 903 can represent the end of criteria 901, indicating that rule 904 only includes the criteria of criteria 901. In some embodiments, stop 903 represents a cancel where a building owner cancels an alarm. In some embodiments, stop 903 is part of criteria 901.

Sequence 902 includes a list of events that root cause analysis system 310 generated from building data transmitted from building network 401 and/or one of security systems 302*a-d*. Sequence 902 is shown to include event 905, event 907, and stop 909. Events 905 and 907 may be separate events and be stored in a database within root cause analysis system 310 with data indicating what the event was and a timestamp indicating when the event occurred. Events 905 and 907 can be any event, such as, but not limited to a door being open for too long, an alarm not being set, a low battery smoke alarm, a ground fault, a faulty power line, etc. Events can be caused by mechanical problems and/or personnel problems. In some embodiments, events 905 and 907 are events that cause a false alarm to go off. Stop 909 stops a sequence of events similar to stop 903. In some embodiments, stop 909 represents an ending to an administrator chosen time frame generated in relation to one of events 905 and/or 907. In some embodiments, event 905 causes an alarm and satisfies criteria 901 of rule 904 so root cause analysis system 310 identifies that rule 904 has been satisfied and is associated with instant match 906. In some embodiments, event 907 causes an alarm and also satisfies criteria 901 of rule 904 so root cause analysis system 310 identifies that rule 904 has been satisfied and is associated with instant match 908.

Instant match 906 and instant match 908 represent rule 904 being satisfied twice based on the same sequence of events. Instant match 906 and instant match 908 can be user interface elements that are represented in an alarm monitoring user interface. Instant match 906 is shown to include an alarm that goes off as a result of event 905 occurring and then an owner cancelling the alarm, resulting in an instant match, or criteria 901 of rule 904 being satisfied. Instant match 908 is shown to include an alarm that goes off as a result of event 907 occurring and then an owner cancelling the alarm, resulting in an instant match, or criteria 901 of rule 904 being satisfied. In some embodiments, the cancel of instant matches 906 and 908 is the same or similar to stop 909. Because rule 904 has been satisfied twice based on the same sequence of events and is associated with the same action recommendation each time, in some embodiments, root cause analysis system 310 can identify that there is only one root cause of the false alarm and consequently only one action needs to be taken. In some embodiments, root cause analysis system 310 can do this by identifying that satisfied criteria 901 in each of instant matches 906 and 908 include a same event, such as stop 909.

Consequently, because root cause analysis system 310 can identify that rule 904 was satisfied twice by a single sequence of events, root cause analysis system 310 can determine one action recommendation 910 to fix the causes of the alarms. This is beneficial because recommending multiple actions to a person, such as a technician that comes to fix the root cause, can cause a headache as the technician will receive, via a processor, a long list of items to fix and actions to take to fix problems that cause false alarms. Further, if root cause analysis system 310 includes a self-healing mechanism where the building can fix some problems by itself (e.g., implement automated device testing, device resetting, implement device firmware updates, etc.), identifying multiple actions to fix the same problem can be repetitive and cause complex code. Examples of actions that root cause analysis system 310 can recommend through action recommendation 910 include, but are not limited to, changing a faulty battery, fixing a wiring system, replacing faulty equipment, changing configurations of pieces of equipment, etc.

Figure 10:
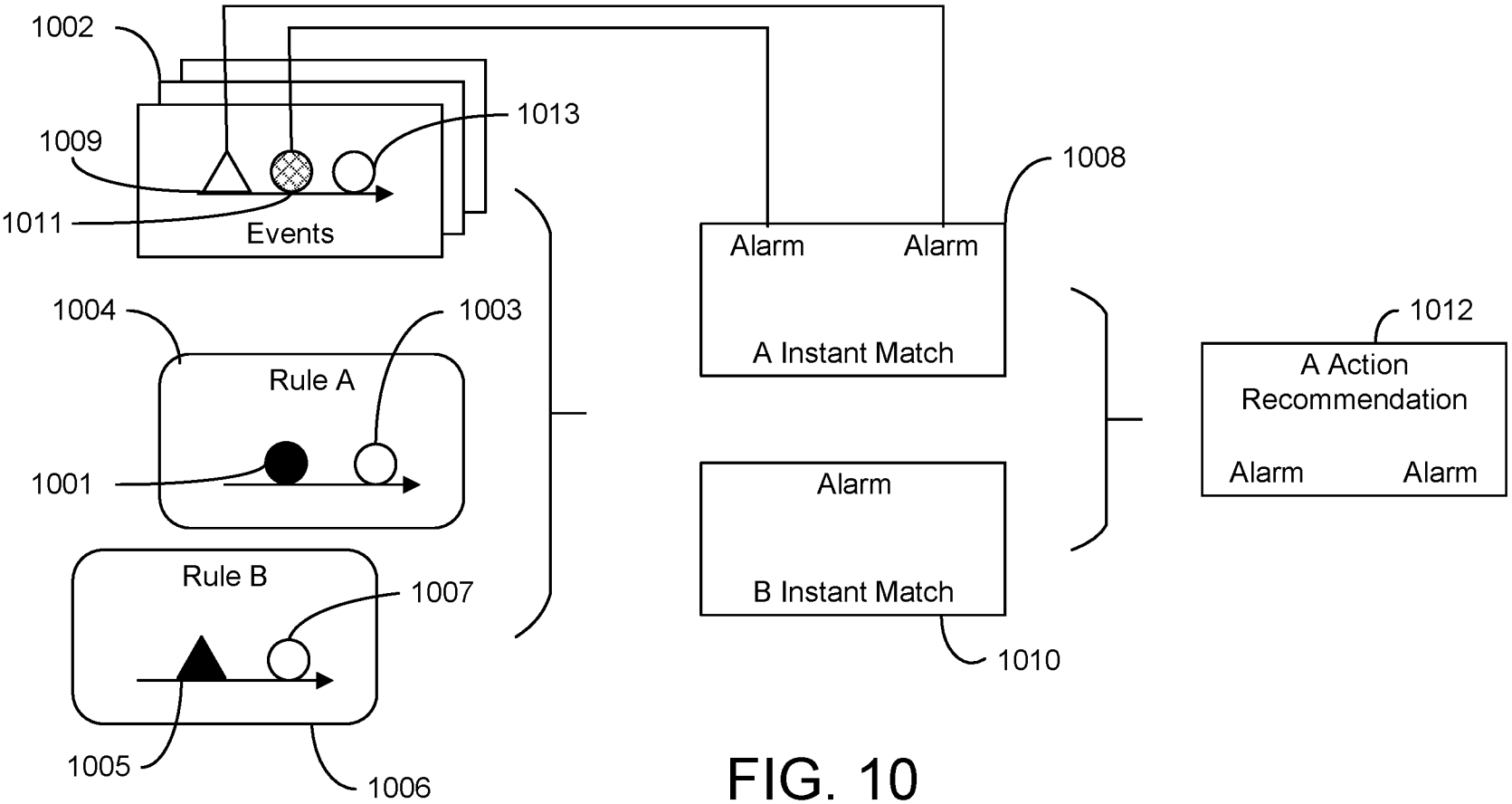
FIG. 10 is a block diagram of two rule patterns that generate an action recommendation, the two rule patterns being applied to a sequence of events that set off alarm, according to an exemplary embodiment.

Referring now to FIG. 10, a flow diagram, including rules 1004 and 1006 being applied to a sequence of events that set off alarms to generate an action recommendation is shown, according to an exemplary embodiment. In some embodiments, the root cause analysis system 310 performs the flow illustrated in FIG. 10. Criteria of rules 1004 and 1006 can be satisfied by the sequence of events. Consequently, root cause analysis system 310 can use a hierarchical relationship between the two rules to determine a root cause of the sequence of events and an action recommendation to send to a technician to fix the root cause. Rule 1004 includes criteria 1001 and stop 1003. Rule 1006 includes criteria 1005 and stop 1007. Rules 1004 and 1006 and their respective components 1001, 1003, 1005, and 1007 can be the same or similar to rule 904 and components 901 and 903 as shown and described with reference to FIG. 9. Events 1002 can be an event list similar to or the same as sequence 902.

Events 1002 is shown to include events 1009 and 1011 and stop 1013. Event 1009 can be an event that satisfies criteria of rule 1006 when it occurs in combination with stop 1013. In some embodiments, event 1009 alone can satisfy criteria 1005 of rule 1006. Similarly, event 1011 can be an event that satisfies criteria of rule 1004 when it occurs along and/or in combination with stop 1013.

Root cause analysis system 310 can determine that rules 1004 and 1006 are satisfied by comparing events 1009 and 1011 and stop 1013 to criteria 1001 and 1005 of rules 1004 and 1006 respectively. If criteria of one or more of rules 1004 and 1006, root cause analysis system 310 can determine that the respective rule is satisfied, or is an instant matches 1008 and 1010. If rule 1004 has been satisfied, root cause analysis system 310 can determine the rule is instant match 1008. Instant match 1006 and instant match 1008 can be user interface elements that are represented in an alarm monitoring user interface. If rule 1006 has been satisfied, root cause analysis system 310 can determine instant match 1010 has been satisfied.

If both of rules 1004 and 1006 have been satisfied, root cause analysis system 310 can identify that there are multiple root causes of a sequence of events and identify action recommendations associated with each root cause. To avoid recommending an action to fix a root cause that did not cause the sequence of events, root cause analysis system 310 can use a relationship hierarchy to determine which rule is associated with a higher classification. As discussed herein, rules can be assigned a classification based on how likely they are to be the root cause of a sequence of events that cause false alarms. Rule classifications can be manually or automatically assigned. Root cause analysis system 310 can identify a satisfied rule with the highest classification as the rule to associate with a root cause of a sequence of events and a corresponding action recommendation.

Root cause analysis system 310 can determine that the criteria for both of rules 1004 and 1006 has been satisfied. Root cause analysis system 310 can scan a relationship hierarchy to determine which rule is associated with a highest classification of rules 1004 and 1006. Root cause analysis system 310 can select rule 1004 as the satisfied rule with the highest classification and generate an action recommendation 1012 based on a root cause associated with rule 1004. Action recommendation 1012 can be the same or similar to action recommendation 910, shown and described in reference to FIG. 9.

Figure 11:
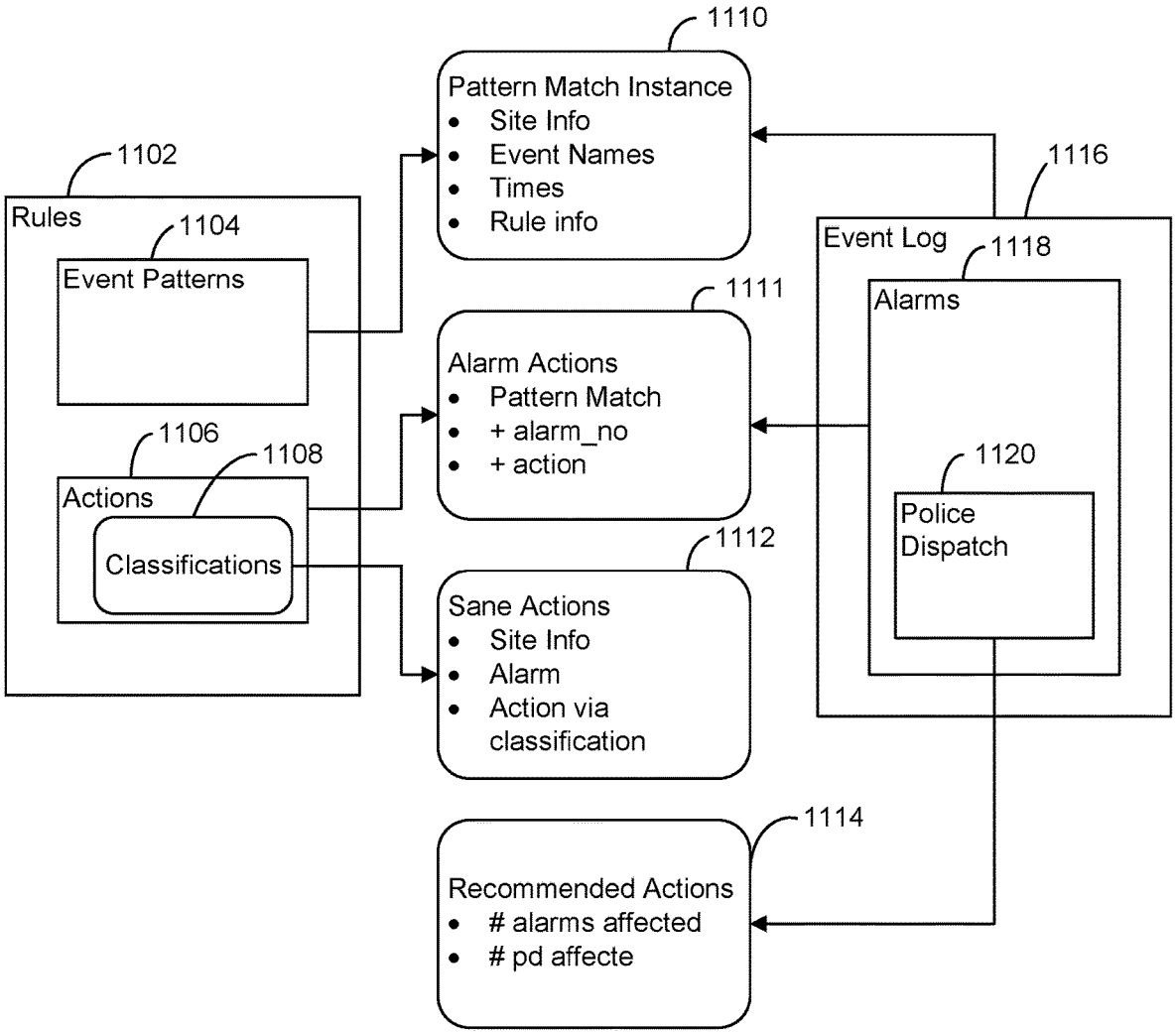
FIG. 11 is a block diagram of matching rules and event patterns to events of an event log to determine an appropriate action recommendation, according to an exemplary embodiment.

Referring now to FIG. 11, a block diagram of components of the root cause analysis system 310 are shown for matching rules and event patterns to events from an event log to determine an appropriate actin recommendation, according to an exemplary embodiment. System 1110 is shown to include rules 1102, pattern match instance 1110, alarm actions 1111, sane actions 1112, recommended actions 1114, and event log 1116. Root cause analysis system 310 can perform a search of event log 1116 for events and event patterns that satisfy rules of rules 1102. In some embodiments, root cause analysis system 310 identifies the events and event patterns and identifies recommended actions based on processes represented by components 1110-1114. Root cause analysis system 310 can identify events and event pattern based on any number of processes that perform any operation.

Rules 1102 is shown to include event pattern 1104 and actions 1106. Each rule can be associated with a different criteria represented by event patterns 1104. Event patterns 1104 can be associated with any number of event patterns and events of any type. In some embodiments, event patterns include a timing requirement where events have to occur within a certain time period to fit into an event pattern and satisfy criteria of a rule of rules 1102.

Rules 1102 is also shown to include actions 1106. Actions 1106 can represent actions associated with each rule that should be undertaken if criteria of a rule is satisfied and selected to be associated with a root cause of a sequence of events. The actions can be sent to an external user device as a recommendation for an action that a user using the user device can take so a root cause of a sequence of alarms and/or events can be fixed. Actions 1106 are shown to include classifications 1108. As discussed above, classifications 1108 can represent a classifications rules or actions that enables root cause analysis system 310 to select a satisfied rule of multiple satisfied rules when a sequence of events and/or alarms satisfies criteria of multiple rules. Root cause analysis system 310 can identify a rule based on a relationship hierarchy (e.g., the relationship hierarchy 500 as described with reference to FIG. 5) and classifications 1108 to determine which rule to select to be associated with a root cause and consequently an action.

In some embodiments, instead of classifications being assigned to rules, classifications are assigned to actions. Root cause analysis system 310 can identify actions associated with each satisfied rule and identify classifications of each action. The action with the highest classification can be selected to be included in an action recommendation to an external user device. In some embodiments, actions have a relationship hierarchy similar to a relationship hierarchy of the rules.

Event log 1116 can be a log of events that occur that cause alarms 1118 and a police dispatch 1120. Event log 1116 can include any number of events that occur and trigger alarms of alarms 1118. In some embodiments, event log 1116 is a list of events that occur within a time period in a database within root cause analysis system 310. Each event can be associated with a time stamp indicating when the event occurred in case criteria of a rule requires events to occur within a certain time period.

Event log 1116 is shown to include alarms 1118. Alarms 1118 can represent all alarms that are triggered by events of event log 1116. Alarms 1118 can be false alarms or alarms triggered as a result of working properly. Once triggered, alarms 1118 can result in police dispatch 1120. If multiple alarms are triggered in a short time span (i.e. during a time period that the police are dispatched to a location and perform their duties at the location), only one alarm is associated with the police dispatch, in some embodiments. Police dispatch 1120 can represent police automatically being sent to a site as a result of at least one of alarms 1118.

Pattern match instance 1110 represents a process conducted by root cause analysis system 310 to match patterns of a rule of rules 1102 with events of event log 1116, in some embodiments. At pattern match instance 1110, root cause analysis system 310 can search through event log 1116 for events and/or sequences of events that match, or satisfy, event patterns 1104 of rules 1102. When searching for events and/or sequences of events, root cause analysis system 310 can search for information about the site the events took place, names of the events, and times stamps associated with the events. Root cause analysis system 310 can use information about the rule, such as time stamp requirements of the rule, when searching for events and event sequences.

Alarm actions 1111 are operations conducted by root cause analysis system 310 to identify actions associated with rules of rule 1102 with their criteria satisfied. In some embodiments, each rule of rules 1102 is associated with an action that can be recommended for a technician to take to fix a root cause of multiple false alarms and/or events. Root cause analysis system 310 can identify the actions associated with rules with rule criteria satisfied.

Sane actions 1112 represents a process conducted by root cause analysis system 310 to identify which action to recommend to a user based on a classification of a satisfied rule or a classification of an action associated with a satisfied rule. Root cause analysis system 310 can identify which action or rule to associated with a root cause of a sequence of alarms by comparing the classifications of the satisfied rules or actions to each other. In some embodiments, root cause analysis system 310 selects the satisfied rule or action with the highest classification as the rule or action associated with an action recommendation to send to an external user.

Recommended actions 1114 represents a process conducted by root cause analysis system 310 to generate and/or transmit an action recommendation to an external user device. Root cause analysis system 310 can generate and/or transmit action recommendations based on the action determined to be associated with a root cause of a sequence of events that caused police dispatch 1120. In some embodiments, recommended actions 1114 can include generating and/or transmitting a recommendation with multiple actions so a technician can fix root causes of a sequence of events caused by multiple issues.

Figure 12:
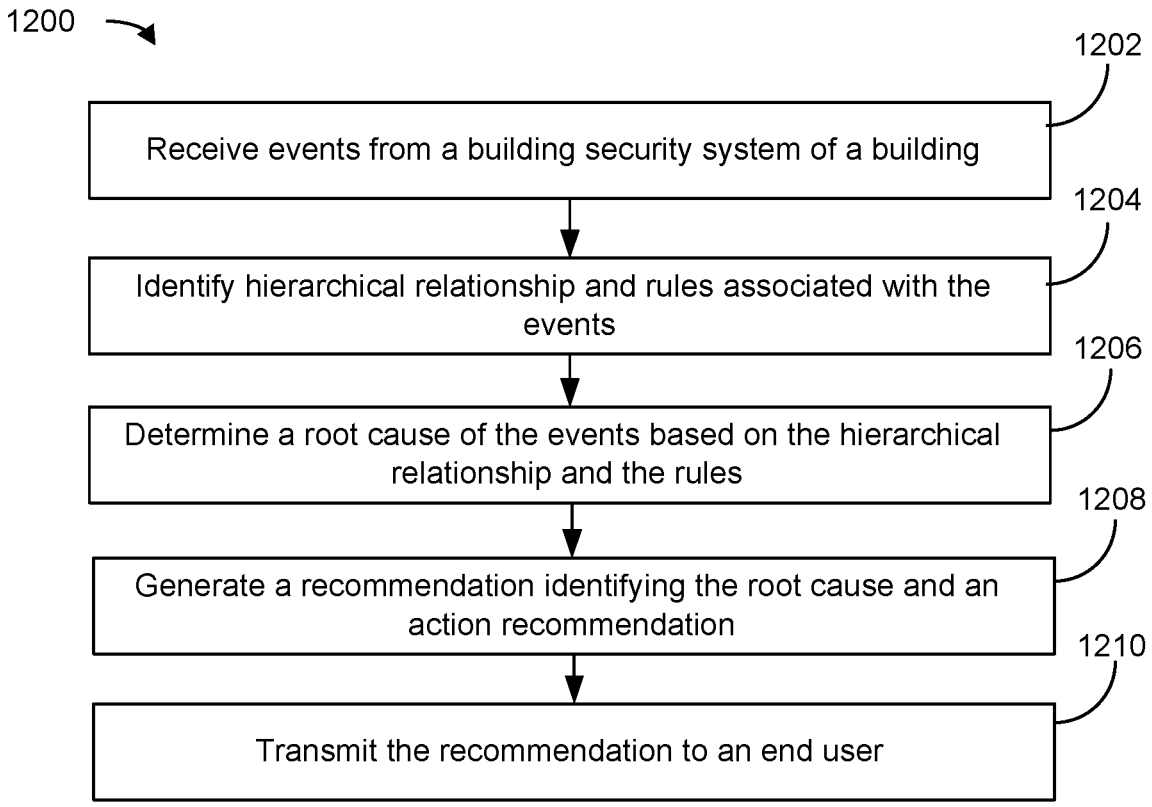
FIG. 12 is a flow diagram of a process for determining a root cause of one or more events based on event data and generating a recommendation including the root cause and an action recommendation, according to an exemplary embodiment.

Referring now to FIG. 12, a flow diagram of a process 1200 for determining a root cause of one or more events based on event data and generating an identifier including the root cause and an action recommendation is shown, according to an exemplary embodiment. Process 1200 is shown to include receive events form a building security system of a building (step 1202), identify hierarchical relationship and rules associated with the events (step 1204), determine a root cause of the events based on the hierarchical relationship and the rules (step 1206), generate a recommendation identifying the root cause and an action recommendation (step 1208), and transmit the recommendation to an end user (step 1210). Process 1200 can include any number of steps and the steps can be performed in any order. In some embodiments, the root cause analysis system 310 is configured to perform one, some, or all of the steps 1202-1210.

At step 1202, root cause analysis system 310 can receive events from a building security system of a building. Root cause analysis system 310 can receive the events periodically as a result of programming and/or configurations of equipment in the building and/or after probing building equipment of the building for events. In some embodiments, the events can be represented as building data and included with other data about the building, such as building characteristics (e.g. temperature, humidity, pressure, etc.). Upon receiving the events, root cause analysis system 310 can store the building events in a database within root cause analysis system 310 as a searchable list with time stamp tags indicating when the events occurred so root cause analysis system 310 can easily determine if events satisfy criteria of a rule.

At step 1204, root cause analysis system 310 can identify hierarchical relationships and rules associated with events that have been satisfied, or had criteria that was satisfied. The hierarchical relationship can be associated with either rules of a rule log discussed above or actions associated with each rule. Each rule and/or action can have a different classification, or ranking, compared to other rules so if criteria of multiple rules is satisfied, root cause analysis system 310 can select the rule and/or action with the highest classification and send an action recommendation to an external user based on the selected rule and/or action. The hierarchical relationship can be generated manually by humans that specify a classification or ranking associated with each rule and/or action, or the hierarchical relationship can be dynamic and automatically generated based on historical data of events and selected rules. If the hierarchical relationship is automatically generated, root cause analysis system 310 can determine the classification or ranking of each rule or action based on how many times the rule and/or action is selected to be associated with a root cause of events that cause false alarms and/or a police dispatch. The more a rule and/or action is selected in comparison to other rules and/or actions, the higher the ranking or classification.

At step 1206, root cause analysis system 310 can determine a root cause of the events based on the hierarchical relationship and rules. Root cause analysis system 310 can determine the root cause after identifying each satisfied rule of the rules in a database within root cause analysis system 310. In some embodiments, root cause analysis system 310 can then compare classifications associated with each satisfied rule to identify the rule with the highest classification. In some embodiments, each rule is associated with a root cause. Root cause analysis system 310 can identify a root cause of the events associated with the satisfied rule with the highest classification as the most likely root cause of the events.

At step 1208, root cause analysis system 310 can generate a recommendation identifying a root cause and an action recommendation. Root cause analysis system 310 can generate the recommendation after identifying an action associated with a root cause identified from a satisfied rule with the highest classification. The action can be a human action or a self-healing action that can be taken to fix the root cause so the events that caused the false alarms and/or police dispatch do not occur again. The recommendation can include multiple actions if multiple actions need to be taken to fix the root cause and/or root cause analysis system 310 identifies multiple root causes. At step 1210, root cause analysis system 310 can transmit the recommendation to an end user at an external device. In some embodiments, the end user is a technician who services a building associated with root cause analysis system 310. In some embodiments, the end user is a self-healing system (not shown) associated with root cause analysis system 310 that can automatically take action to fix the root cause. Root cause analysis system 310 can be a part of the self-healing system.

Figure 13:
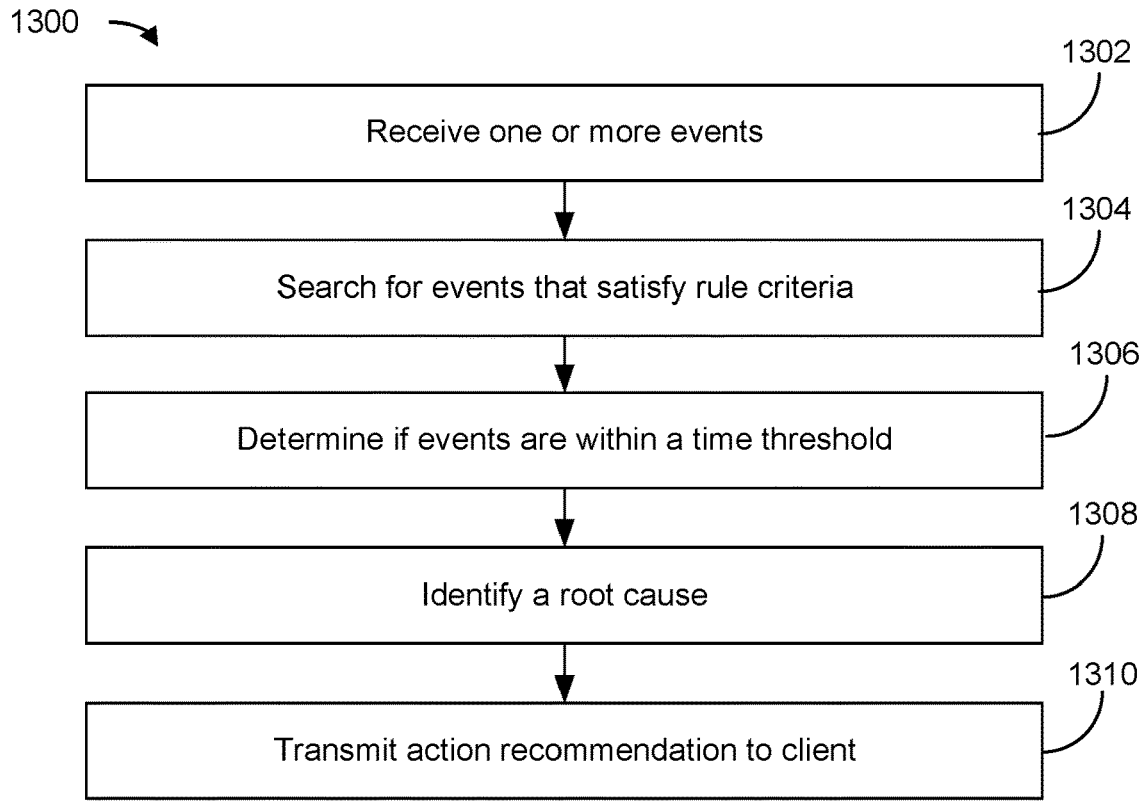
FIG. 13 is a flow diagram of a process for determining if a rule has been satisfied based on building data including a sequence of events, according to an exemplary embodiment.

Referring now to FIG. 13, a flow diagram of a process 1300 for determining if a rule has been satisfied based on building data including a sequence of events is shown, according to an exemplary embodiment. Process 1300 includes receive multiple events (step 1302), search for events that satisfy rule criteria (step 1304), determine if events are within a time threshold (step 1306), identify a root cause (step 1308), and transmit action recommendation to client (step 1310). Process 1300 can include any number of steps and the steps can be performed in any order. Each of steps 1302-1308 can be conducted by root cause analysis system 310.

At step 1302, root cause analysis system 310 can receive one or more events as building data from building network 401 and/or one of security systems 302*a-d*. Similar to step 1202 of process 1200, shown and described with reference to FIG. 12, root cause analysis system 310 can receive the events in addition to other data about an associated building. In some embodiments, root cause analysis system 310 receives the events after an event that causes an alarm (or false alarm) or a sequence of events that occur within a short period of time occurs. In some embodiments, root cause analysis system 310 receives the events at preset times so root cause analysis system 310 can analyze the events at once. In some embodiments, root cause analysis system 310 can update a database dynamically so the database is up to date on false alarms and events that cause false alarms. Advantageously, by updating the database each time after receiving building data, root cause analysis system 310 can constantly update a hierarchical relationship discussed herein so the classifications of rules can be calculated based on as much data as possible.

At step 1304, root cause analysis system 310 can search for events that satisfy rule criteria of a rule in a database within root cause analysis system 310. Root cause analysis system 310 can search the database for events and event sequences associated with each rule. In some instances, criteria of a rule requires that events occur within a specific pattern. In such instances, when Root cause analysis system 310 is searching for events that that fit into the specific pattern, Root cause analysis system 310 searches for the first event of the pattern. If root cause analysis system 310 finds the first event, Root cause analysis system 310 can search for a second event of the pattern and repeat the process until identifying each event of the pattern. If root cause analysis system 310 does not find an event of the pattern, however, root cause analysis system 310 can stop searching for events associated with the rule and move on to search for events that match criteria of another rule. In some embodiments, root cause analysis system 310 can search for satisfied for any number of rules within a database within Root cause analysis system 310.

At step 1306, root cause analysis system 310 can determine if events of a satisfied rule are within any time thresholds associated with the rule. In some instances, rules can have time thresholds where, to be satisfied, the events must occur within the time threshold. If the events of a rule pattern occur but not within the time threshold, root cause analysis system 310 can determine that the rule is not satisfied. For example, a rule may require that an event representing a low battery occur within five minutes of an event representing a faulty device. If both events happen within the five minute threshold, then the rule can be satisfied. However, if the events occur within more than five minutes, root cause analysis system 310 can determine that the rule is not satisfied. In some embodiments, events may occur between the two rules. The events can cause a rule to not be satisfied depending on the rule. Some rules can require events to occur directly after one another, while other rules can allow for events to occur between associated with an event pattern.

At step 1308, root cause analysis system 310 can identify a root cause of a sequence of events based on the identified rule. Each rule can be associated with a root cause that caused the events of the rule to occur. Continuing with the example above, a rule that is satisfied based on the battery of a smoke detector event and the defective device can be associated with a low battery root cause. Consequently, Root cause analysis system 310 can easily determine the root cause of a sequence of events based on which rule is satisfied.

At step 1310, root cause analysis system 310 can transmit an action recommendation to a client. Root cause analysis system 310 can transmit the action recommendation after identifying an action associated with the root cause. Each root cause can have an action associated with it. Actions can be actions that technicians or a self-healing system can undertake to repair the root cause so false alarms are not caused in the future. Root cause analysis system 310 can determine which action is associated with the root cause using a table within root cause analysis system 310. In some embodiments, root cause analysis system 310 sends an action recommendation to the client with instructions on how to perform an action to repair the root cause. In some embodiments, root cause analysis system 310 can identify that the root cause can be repaired by a self-healing system and send the action recommendations to the self-healing system.

Figure 14:
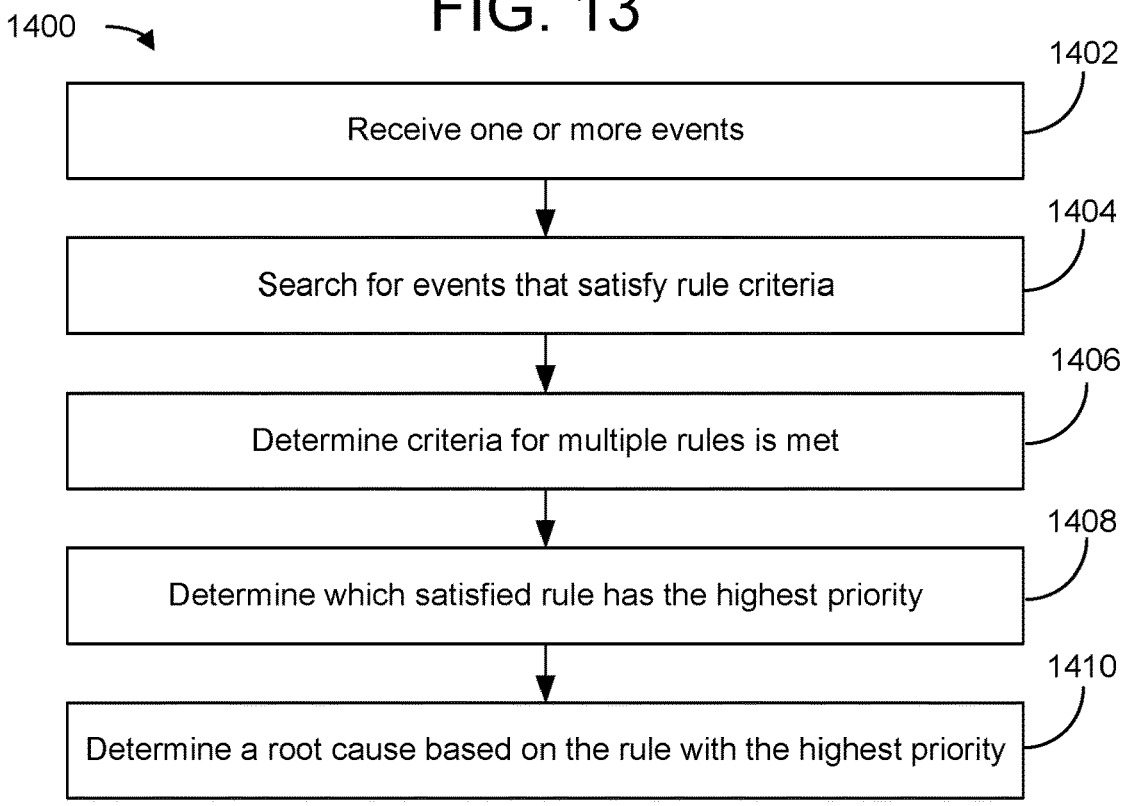
FIG. 14 is a flow diagram of a process for determining a root cause of a sequence of events when more than one rule has been satisfied, according to an exemplary embodiment.

Referring now to FIG. 14, a flow diagram of a process 1400 for determining a root cause of a sequence of events when more than one rule has been satisfied is shown, according to an exemplary embodiment. Process 1400 is shown to include receive one or more events (step 1402), search for events that satisfy rule criteria (step 1404), determine criteria for multiple rules is met (1406), and determine a root cause based on the rule with the highest classification (step 1410). Steps 1402-1410 can be conducted by root cause analysis system 310. Process 1400 can include any number of steps and the steps can be performed in any order. Steps 1402 and 1404 can be the same or similar to steps 1302 and 1304 of process 1300, shown and described with reference to FIG. 13. A potential difference can be that root cause analysis system 310 searches for multiple, if not all of, the rules within a database in root cause analysis system 310 to determine which rules have been satisfied.

At step 1406, root cause analysis system 310 can determine that criteria for multiple rules has been met by a sequence of events. Implementing steps 1304 and 1306 of process 1300, Root cause analysis system 310 can identify multiple rules with criteria that is satisfied by a sequence of events. root cause analysis system 310 can do so by identifying events that match rule patterns of different rules and determining if the events occur within time threshold of the rules.

At step 1408, root cause analysis system 310 can determine which satisfied rule has the highest classification. A satisfied rule can be a rule with rule criteria satisfied by a sequence of events. Each rule can be associated with a different classification. Classifications of rules can be associates with a hierarchical relationship that identifies a likelihood that a rule is associated with a root cause. As discussed herein, classifications of the hierarchical relationship can be determined manually based on a human input or automatically based on historical data indicating probabilities of each root cause. Classifications can be tags associated with each rule. Root cause analysis system 310 can identify each satisfied rule and determine which rule has the highest classification based on the classification of each satisfied rule. At step 1410, root cause analysis system 310 can determine a root cause of a sequence of events based on the satisfied rule determine to have the highest classification.

Figure 15:
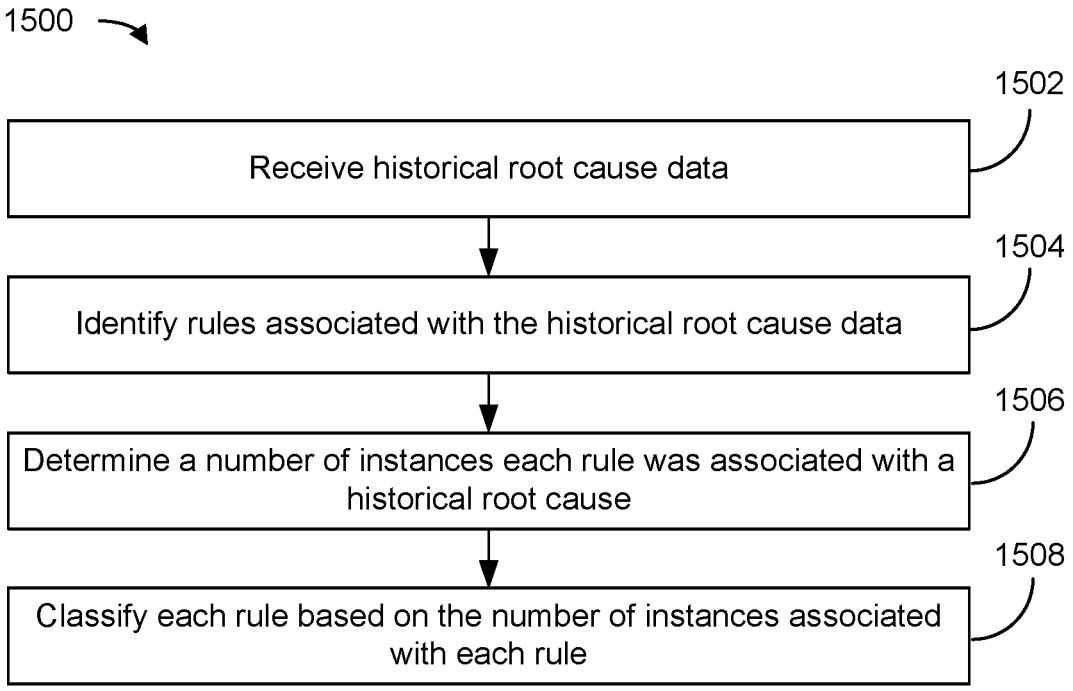
FIG. 15 is a flow diagram of a process for classifying rules in a rule database based on historical root cause data, according to an exemplary embodiment.

Referring now to FIG. 15, a flow diagram of a process 1500 for classifying rules in a rule database based on historical root cause data is shown, according to an exemplary embodiment. Process 1500 is shown to include receive historical root cause data (step 1502), identify rules associated with the historical root cause data (step 1504), determine a number of instances each rule was associated with a root cause (step 1506), and classify each rule based on the number of times associated with each rule (step 1508). Process 1500 can include any number of steps and the steps can be performed in any order. Root cause analysis system 310 can conduct each of steps 1502-1508.

At step 1502, root cause analysis system 310 can receive historical root cause data that includes rules determined to be associated with previous root causes. In some embodiments the historical root cause data can include training data that is manually tagged by humans. The historical root cause data can be stored in a database within root cause analysis system 310. The historical root cause data can include sequence of events that occurred and an indicator indicating which rule was determined to be associated with a root cause that caused the sequence of events. At step 1504, root cause analysis system 310 can identify the rules determined to be associated with each historical root cause. Root cause analysis system 310 can identify the rules by identifying tags associated with each root cause of the historical root cause data and matching the identified tag with a rule within a database within root cause analysis system 310.

At step 1506, root cause analysis system 310 can determine a number of instances that each rule was associated with a historical root cause. In some embodiments, root cause analysis system 310 can implement a counter that iteratively increases by one every time a rule is determined to be associated with a root cause of a sequence of events. Root cause analysis system 310 can keep a counter for each rule in the database within root cause analysis system 310. At step 1508, root cause analysis system 310 can classify each rule based on the number of instances each rule is determined to be associated with a root cause of a sequence of events. Root cause analysis system 310 can compare counters of each rule rank the rules based on the number associated with each counter. For example, a rule associated with the highest number can be ranked first while a rule associated with the lowest number can be ranked last, in some embodiments. Rules can be ranked in any order.

Figure 16:
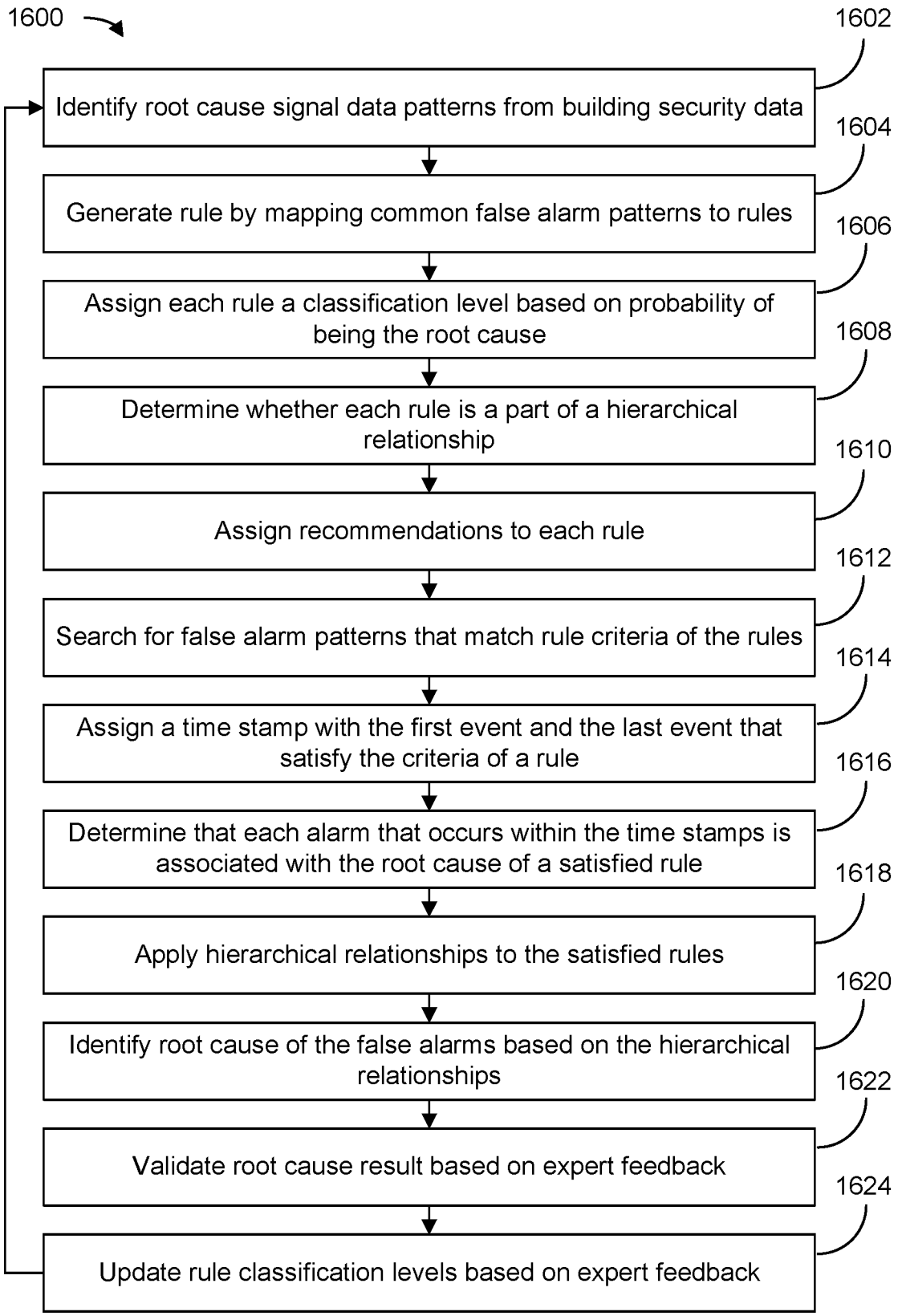
FIG. 16 is a flow diagram of a process for determining a root cause of one or more events based on event data and updating a hierarchical relationship based on expert feedback, according to an exemplary embodiments.

Referring now to FIG. 16, a flow diagram of a process 1600 for determining a root cause of one or more events based on event data and updating a hierarchical relationship based on expert feedback is shown, according to an exemplary embodiment. Process 1600 is shown to include identify root cause signal data patterns from building security data (step 1602), generate rule by mapping common false alarm patterns to rules (step 1604), assign each rule a classification level based on probability of being the root cause (step 1606), determine whether the rule is a part of a hierarchical relationship (step 1608), assign recommendations to each rule (step 1610), search for false alarm patterns that match rule criteria of the rules (step 1612), assign a time stamp with the first event and the last event that satisfy the criteria of a rule (step 1614), determine that each alarm that occurs within the time stamps is associated with the root cause of a satisfied rule (step 1616), apply hierarchical relationships to the satisfied rules (step 1618), identify root cause of the false alarms based on the hierarchical relationships (step 1620), validate root cause result based on expert feedback (step 1622), and update rule classification levels based on expert feedback (step 1624). Process 1600 can include any number of steps and the steps can be performed in any order. Root cause analysis system 310 can conduct each of steps 1602-1624.

At step 1602, root cause analysis system 310 can identify root cause signal data patterns from building security data. In some embodiments, root cause analysis system 310 can identify specific events that must occur in a specific order and/or time periods that the events must occur in as a part of the root cause signal data patterns. Root cause analysis system 310 can identify the patterns based on common events that generally occur together in a particular order. For example, a false fire alarm can be associated with a weak fire alarm battery and another false fire alarm can be associated with the smoke detector detecting dust as smoke. Root cause analysis system 310 can identify the root cause of the false alarms to be the smoke detector is low on battery, and identify the pattern that caused it. Root cause analysis system 310 can identify any number of patterns for root causes of false alarms. In some embodiments, an administrator can check the pattern and the identified root cause to determine if it is accurate. If it is inaccurate, the administrator can adjust the pattern to associate with the correct false alarm and to have the correct parameters based on the personal knowledge of the administrator (i.e., include the correct events and the correct time frame). In some embodiments, an administrator may manually generate the patterns and root causes. At step 1604, root cause analysis system 310 can generate rules for each identified pattern of false alarms by including the patterns in rules.

At step 1606, root cause analysis system 310 can assign each rule a classification level based on the knowledge of an administrator and a probability that the rules are the root cause of a series of false alarms. Root cause analysis system 310 can proportionally assign classification levels of a hierarchical relationship so rules associated with root causes that are more likely can be assigned higher classification levels than rules that are associated with root causes that are less likely. At step 1608, root cause analysis system 310 can assign each rule a true/false value indicating whether the rule is a part of a hierarchical relationship. Root cause analysis system 310 can assign a "true" value if the rule is a part of the hierarchical relationship and a "false" value if value if the rule is not a part of the hierarchical relationship. This is advantageous because root cause analysis system 310 can eliminate rules from consideration that are known to never be (or have an extremely low probability of being) root causes for false alarms.

Root cause analysis system 310 can include rules with satisfied criteria and associated action recommendations in a recommendation or report that also indicates the true root cause of a series of false alarm. For example, root cause analysis system 310 may include the following language in a report: "While the false alarm was caused by a low battery, we did not have up-to-date phone records to call and check with someone and were forced to call the police." In the example, a stale call tree made a problem caused by an identified root cause worse. Root cause analysis system 310 can identify the rule with the stale call tree based on satisfied rule criteria and include an action recommendation to fix the stale call tree in a recommendation to an operator along with the identified root cause and an action recommendation to fix the root cause.

At step 1610, root cause analysis system 310 can assign recommendations to each rule. Each rule can be associated with a recommendation that is associated with a solution to fixing a root cause associated with a satisfied rule. In some instances, when multiple actions need to be taken to avoid future false alarms, more than one recommendation can be associated with a satisfied rule. For example, if a rule is associated with a low battery in a smoke detector, root cause analysis system 310 can assign an action recommendation to the rule to replace the battery of the smoke detector. The action recommendations can be manually generated by an administrator, in some embodiments.

At step 1612, root cause analysis system 310 can search for false alarm patterns that match rule criteria of the rules. Root cause analysis system 310 can do so by implementing steps similar to steps 1304 and 1306 described in reference to FIG. 13. At step 1614, root cause analysis system 310 can assign a time stamp to the first events of the satisfied rules and to the last events of the satisfied rules. The root cause analysis system can identity time period between the time stamps of the satisfied rules. At step 1616, the root cause analysis system 310 can determine that each alarm and police dispatch (event) that occurs during the time periods are associated with the satisfied rules of the time periods.

At step 1618, root cause analysis system 310 can apply hierarchical relationships to the satisfied rules. Each rule that is satisfied by a pattern of data is given its classification level for likelihood of being the root cause of a false alarm and whether or not it is associated with a "true" or "false" value. Root cause analysis system 310 can identify the satisfied rules associated with the true value and identify the classification levels of the satisfied rules with the true value. At step 1620, root cause analysis system 310 can identify the satisfied rule of the rules with the true values that has the highest classification level as being associated with the root cause of a series of events that cause false alarms. Root cause analysis system 310 can also identify satisfied rules with false values. Root cause analysis system 310 can provide a report to an administrator with an action recommendations associated with the root cause and the associated satisfied rule. Root cause analysis system 310 can also include satisfied rules associated with the false values in the report.

At step 1622, root cause analysis system 310 can validate the root cause identified in step 1620 based on expert feedback. A human monitor can check the identified root cause to determine if it was the correct root cause. In some embodiments, the human monitor can validate the root cause by selecting a "correct" button on a graphical user interface, if the identified root cause was correct. In some embodiments the human monitor can invalidate the root cause by selecting an "incorrect" button a graphical user interface, if the identified root cause was incorrect. The human monitor can select the correct root cause from the same graphical user interface. At step 1624, root cause analysis system 310 can identify the expert feedback from the human monitor and automatically update the hierarchical relationship based on the expert feedback. Root cause analysis system 310 can include the actual root cause of a series of false alarms to determine the probabilities that each rule is associated with a root cause. Root cause analysis system 310 can identify the rule associated with the actual root cause as more likely than before. In some instances, the actual root cause may be associated with multiple rules. Consequently, the root cause analysis system 310 can identify each rule associated with the root cause as being more likely. Root cause analysis system 310 can update the hierarchical relationship based on the updated probabilities. For example, if identifying the actual root cause caused an associated rule to be more probable than a root cause of another rule, root cause analysis system 310 change the classification levels of each rule accordingly.

Advantageously, by using rules and patterns, root cause analysis system 310 can determine a root cause of a sequence of events that cause false alarms. Previous systems could only identify causes of each event in a sequence of events, and often had trouble doing so when only one event was stored that resulted in a police dispatch. Consequently, because root cause analysis system 310 can identify each event in a sequence of events that cause a police dispatch, root cause analysis system 310 can quickly determine what caused the sequence of events. Root cause analysis system 310 can use a hierarchical relationship to determine a root cause when multiple potential root causes are determined, which allows for a more accurate determination. Further, implementing the systems and methods described herein can greatly simplify false alarm reduction systems because sequences of events can be consolidated into a single sequence caused by a root cause instead of multiple events, each event having a different root cause.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for reducing false alarms of a building, the system comprising a processing circuit configured to:

receive building security data of the building, the building security data comprising one or more events;

identify a plurality of satisfied rules of a plurality of rules based on the one or more events, wherein each of the plurality of rules is associated with a particular sequence of one or more particular events;

select one satisfied rule of the plurality of satisfied rules based on a rule hierarchy, wherein the rule hierarchy indicates a classification level of each of the plurality of satisfied rules; and generate a recommendation for reducing a false alarm associated with the one satisfied rule, wherein the recommendation comprises an indication of a root cause of the false alarm.

2. The system of claim 1, wherein each rule of the plurality of rules is associated with a plurality of events occurring in a particular event pattern.

3. The system of claim 1, wherein each rule of the plurality of satisfied rules is associated with a classification level within the rule hierarchy;

wherein the processing circuit is configured to:

identify the classification level associated with each of the plurality of satisfied rules;

compare the classification level of each of the plurality of satisfied rules; and determine the root cause based on the comparison of the classification level of each of the plurality of satisfied rules.

4. The system of claim 1, wherein the processing circuit is configured to determine the rule hierarchy by:

receiving historical building data associated with a plurality of root causes;

determining a number of instances that each rule of the plurality of rules is satisfied by the historical events; and setting classification levels for each of the plurality of rules based on the number of instances that each rule of the plurality of rules is satisfied.

5. The system of claim 1, wherein the plurality of satisfied rules comprises a first satisfied rule and a second satisfied rule, wherein the rule hierarchy associates a first classification level with the first satisfied rule and a second classification level with the second satisfied rule;

wherein the processing circuit is configured to:

select the first satisfied rule in response to a determination that the first classification level is greater than the second classification level; and generate a first recommendation for reducing a first false alarm associated with the first satisfied rule in response to the determination that the first classification level is greater than the second classification level.

6. The system of claim 1, wherein a first rule of the plurality of rules is associated with a first sequence, wherein the first sequence comprises a first event and a second event occurring in order sequentially within a time period;

wherein the processing circuit is configured to identify the plurality of satisfied rules by determining whether the first rule is satisfied by identifying whether the one or more events include the first event and the second event occurring in order sequentially within the time period.

7. The system of claim 6, wherein determining whether the first rule is satisfied comprises determining whether a third event of the one or more events occurs at a time between the first event and the second event.

8. The system of claim 1, wherein the processing circuit is configured to identify the plurality of satisfied rules of the plurality of rules by:

generating a list comprising the one or more events;

identifying criteria of each the plurality of rules, wherein the criteria comprises one or more particular events and one or more particular sequences of the one or more particular events; and searching the list for the one or more particular events and the one or more particular sequences of the one or more particular events.

9. The system of claim 8, wherein searching the list for the one or more events and the one or more particular sequences of the one or more particular events comprises:

repeatedly searching the list for the one or more particular events and the one or more particular sequences of the one or more particular events for each of the plurality of rules.

10. A method for reducing false alarms of a building, the method conducted by a processing circuit and comprising:

receiving, by the processing circuit, building security data of the building, the building security data comprising one or more events;

identifying, by the processing circuit, a plurality of satisfied rules of a plurality of rules based on the one or more events, wherein each of the plurality of rules is associated with a particular sequence of one or more particular events;

selecting, by the processing circuit, one satisfied rule of the plurality of satisfied rules based on a rule hierarchy, wherein the rule hierarchy indicates a classification level of each of the plurality of satisfied rules; and generating, by the processing circuit, a recommendation for reducing a false alarm associated with the one satisfied rule, wherein the recommendation comprises an indication of a root cause of the false alarm.

11. The method of claim 10, wherein each rule of the plurality of rules is associated with a plurality of events occurring in a particular event pattern.

12. The method of claim 10, wherein each rule of the plurality of satisfied rules is associated with a classification level within the rule hierarchy;

wherein the method comprises:

identifying, by the processing circuit, the classification level associated with each of the plurality of satisfied rules;

comparing, by the processing circuit, the classification level of each of the plurality of satisfied rules; and determining, by the processing circuit, the root cause based on the comparison of the classification level of each of the plurality of satisfied rules.

13. The method of claim 10, comprising determining, by the processing circuit, the rule hierarchy by:

receiving historical building data associated with a plurality of root causes;

determining a number of instances that each rule of the plurality of rules is satisfied by the historical events; and setting classification levels for each of the plurality of rules based on the number of instances that each rule of the plurality of rules is satisfied.

14. The method of claim 10, wherein the plurality of satisfied rules comprises a first satisfied rule and a second satisfied rule, wherein the rule hierarchy associates a first classification level with the first satisfied rule and a second classification level with the second satisfied rule;

wherein the method comprises:

selecting, by the processing circuit, the first satisfied rule in response to a determination that the first classification level is greater than the second classification level; and generating, by the processing circuit, a first recommendation for reducing a first false alarm associated with the first satisfied rule in response to the determination that the first classification level is greater than the second classification level.

15. The method of claim 10, wherein a first rule of the plurality of rules is associated with a first sequence, wherein the first sequence comprises a first event and a second event occurring in order sequentially within a time period;

wherein the method comprises identifying, by the processing circuit, the plurality of satisfied rules by determining whether the first rule is satisfied by identifying whether the one or more events include the first event and the second event occurring in order sequentially within the time period.

16. The method of claim 15, wherein determining whether the first rule is satisfied comprises determining whether a third event of the one or more events occurs at a time between the first event and the second event.

17. The method of claim 10, wherein identifying the plurality of satisfied rules of the plurality of rules comprises:

generating a list comprising the one or more events;

identifying criteria of each the plurality of rules, wherein the criteria comprises one or more particular events and one or more particular sequences of the one or more particular events; and searching the list for the one or more particular events and the one or more particular sequences of the one or more particular events.

18. The method of claim 17, wherein searching the list for the one or more events and the one or more particular sequences of the one or more particular events comprises:

repeatedly searching the list for the one or more particular events and the one or more particular sequences of the one or more particular events for each of the plurality of rules.

19. A non-transitory computer-readable storage medium having instructions stored thereon that, upon execution by a processor, cause the processor to perform operations to reduce false alarms of a building, the operations comprising:

receiving building security data of the building, the building security data comprising one or more events;

identifying a plurality of satisfied rules of a plurality of rules based on the one or more events, wherein each of the plurality of rules is associated with a particular sequence of one or more particular events;

selecting one satisfied rule of the plurality of satisfied rules based on a rule hierarchy, wherein the rule hierarchy indicates a classification level of each of the plurality of satisfied rules; and generating a recommendation for reducing a false alarm associated with the one satisfied rule, wherein the recommendation comprises an indication of a root cause of the false alarm.

20. The non-transitory computer-readable storage medium of claim 19, wherein each rule of the plurality of satisfied rules is associated with a classification level within the rule hierarchy;

wherein the operations comprise:

identifying the classification level associated with each of the plurality of satisfied rules;

comparing the classification level of each of the plurality of satisfied rules; and determining the root cause based on the comparison of the classification level of each of the plurality of satisfied rules.

* * * * *